US008534791B2

(12) United States Patent
Takata et al.

(10) Patent No.: US 8,534,791 B2
(45) Date of Patent: Sep. 17, 2013

(54) LIQUID DROPLET JETTING APPARATUS

(75) Inventors: Masayuki Takata, Nagoya (JP); Tomoyuki Kubo, Nagoya (JP); Hiroto Sugahara, Ama (JP); Yoshinori Yokoe, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 240 days.

(21) Appl. No.: 13/046,003

(22) Filed: Mar. 11, 2011

(65) Prior Publication Data

US 2011/0242158 A1 Oct. 6, 2011

(30) Foreign Application Priority Data

Mar. 30, 2010 (JP) ..... 2010-078526

(51) Int. Cl.
*B41J 29/393* (2006.01)

(52) U.S. Cl.
USPC ..... 347/19; 347/85

(58) Field of Classification Search
USPC ..... 347/19, 84, 85, 92
See application file for complete search history.

(56) References Cited

U.S. PATENT DOCUMENTS

| | | | | |
|---|---|---|---|---|
| 4,700,870 | A * | 10/1987 | Schleicher et al. | 222/63 |
| 5,500,657 | A | 3/1996 | Yauchi et al. | |
| 7,201,475 | B2 | 4/2007 | Shiho et al. | |
| 7,621,626 | B2 * | 11/2009 | Umeda | 347/85 |
| 2003/0020788 | A1 | 1/2003 | Asano | |
| 2003/0160846 | A1 | 8/2003 | Yoshida et al. | |
| 2003/0218660 | A1 | 11/2003 | Matsumoto et al. | |
| 2005/0024449 | A1 | 2/2005 | Shiho et al. | |
| 2005/0083382 | A1 | 4/2005 | Shiho et al. | |
| 2005/0140752 | A1 | 6/2005 | Shiho et al. | |
| 2006/0209142 | A1 | 9/2006 | Kachi | |
| 2007/0024681 | A1 * | 2/2007 | Umeda | 347/84 |
| 2007/0040877 | A1 | 2/2007 | Kachi | |
| 2007/0070134 | A1 | 3/2007 | Shiho et al. | |
| 2007/0242112 | A1 | 10/2007 | Yazawa | |
| 2008/0218571 | A1 | 9/2008 | Nishimori | |
| 2008/0246795 | A1 | 10/2008 | Azami et al. | |
| 2009/0066737 | A1 | 3/2009 | Sakurai | |
| 2009/0195588 | A1 | 8/2009 | Ogama | |
| 2010/0149232 | A1 | 6/2010 | Cai | |
| 2010/0214332 | A1 | 8/2010 | Iwase | |

FOREIGN PATENT DOCUMENTS

| | | | |
|---|---|---|---|
| EP | 1997639 | A1 | 12/2008 |
| EP | 2208618 | A1 | 7/2010 |
| JP | S57-070670 | A | 5/1982 |
| JP | S57-137178 | A | 8/1982 |

(Continued)

OTHER PUBLICATIONS

English Machine Translation JP-2007-160629.*

(Continued)

*Primary Examiner* — Julian Huffman
*Assistant Examiner* — Sharon A Polk
(74) *Attorney, Agent, or Firm* — Baker Botts L.L.P.

(57) ABSTRACT

A liquid droplet jetting apparatus comprises a liquid droplet jetting head which jets liquid droplets, a storage tank which stores a liquid to be jetted by the liquid droplet-jetting head, a tube which connects the liquid droplet jetting head and the storage tank, and a liquid-state detecting mechanism which detects a state of the liquid contained in the tube at a plurality of positions in a longitudinal direction of the tube.

19 Claims, 21 Drawing Sheets

(56) References Cited

FOREIGN PATENT DOCUMENTS

| | | | | |
|---|---|---|---|---|
| JP | H05-057905 | A | | 3/1993 |
| JP | H10-157161 | A | | 6/1998 |
| JP | 2002-00771 | A | | 7/2002 |
| JP | 2004-188647 | A | | 7/2004 |
| JP | 2004-294147 | A | | 10/2004 |
| JP | 2004-330709 | A | | 11/2004 |
| JP | 2005-238582 | A | | 9/2005 |
| JP | 2005-288766 | A | | 10/2005 |
| JP | 2006-256230 | A | | 9/2006 |
| JP | 2007-055256 | A | | 3/2007 |
| JP | 2007-160629 | A | | 6/2007 |
| JP | 2008-087217 | A | | 4/2008 |
| JP | 2010036517 | A | * | 2/2010 |
| WO | 96/34755 | A1 | | 11/1996 |

OTHER PUBLICATIONS

English Machine Translation JP 2005 238582A.*

English Machine Translation JP-2005 288766A.*

English Machine Translation JP-2006 256230A.*

English Machine Translation JP-2003-320680.*

European Patent Office, partial European Search Report for European Patent Application No. 11001992.4 (counterpart to above-captioned patent application), dated Apr. 17, 2012.

European Patent Office, extended European Search Report for European Patent Application No. 11001992.4 (counterpart European patent application), dated Oct. 10, 2012.

Japan Patent Office, Notice of Reasons for Rejection for Japanese Patent Application No. 2010-078526 (counterpart Japanese patent application), mailed Sep. 11, 2012.

State Intellectual Property Office of the People's Republic of China, Notification of First Office Action for Chinese Patent Application No. 201110059288.6 (counterpart Chinese patent application), mailed Apr. 3, 2013.

* cited by examiner

LIQUID DROPLET JETTING APPARATUS

CROSS REFERENCE TO RELATED APPLICATION

The present application claims priority from Japanese Patent Application No. 2010-078526, filed on Mar. 30, 2010, the disclosure of which is incorporated herein by reference in its entirety.

BACKGROUND OF THE INVENTION

1. Field of the Invention

The present invention relates to a liquid droplet jetting apparatus for jetting liquid droplets.

2. Description of the Related Art

An ink jet printer has been hitherto widely known, in which an ink-jet head and tanks (ink cartridges) for storing inks are connected by means of tubes, and the inks are supplied to the ink-jet head via the tubes. A flexible tube, which is formed of, for example, a synthetic resin material, is generally used for each of the tubes, for the following various reasons. That is, it is intended that the tube can be freely laid out to secure the degree of freedom of the layout. In another viewpoint, it is intended to avoid the disturbance of movement of the head as thoroughly as possible, which would be otherwise caused by the tubes when the head is moved.

The state of the ink contained in the tube has been hitherto detected for various reasons. For example, an ink jet printer (ink-jet recording apparatus) disclosed in Japanese Patent Application Laid-open No. 5-57905 includes a sensor (optical detector) which detects the presence or absence of the ink and which is provided at an intermediate position of a tube for connecting an ink jet head and an ink cartridge, wherein the exhaustion of the ink in the ink cartridge is detected by means of the sensor.

Japanese Patent Application Laid-open No. 10-157161 discloses an ink-jet printer which is configured to perform the gradational recording by using a plurality of types of inks having different concentrations. The concentration of the ink is raised on account of the evaporation or vaporization of a solvent. An ink concentration detecting section, which detects the increase in the ink concentration, is provided at an intermediate position of a tube for connecting an ink jet head and an ink cartridge. The amount of a dilution liquid (diluent) to be added to the ink is controlled to adjust the concentration of the ink to be supplied to the ink-jet head on the basis of a detection result obtained by the ink concentration detecting section.

On the other hand, it is feared that the air may be mixed in from a connecting portion between an ink jet head and a tube and/or a connecting portion between the tube and a tank to form any bubble. If such a bubble is fed to the head together with the ink, any harmful influence is exerted on the liquid droplet jetting performed by the head. In order to solve this problem, an ink jet printer disclosed in Japanese Patent Application Laid-open No. 2004-188647 has a transmission type photosensor which detects any bubble contained in a tube and which is provided at a connecting portion of an ink-jet head connected to the tube.

As disclosed in Japanese Patent Application Laid-open Nos. 10-157161 and 2004-188647, any bubble is generated in the tube during the ordinary use, and/or the ink contained in the ink is dried to increase or raise the concentration (viscosity) of the ink. In the following description, the expression that "the viscosity of the ink is increased or raised" also includes the meaning of the increase in the concentration of the ink. For example, the air enters through the connecting portion of the tank when the tank (ink cartridge) is exchanged, and the bubble is mixed into the tube in some cases. On the other hand, the flexible tube, which is formed of, for example, the synthetic resin material, generally has the gas permeability. Therefore, if the flexible tube is left to stand for long period of time, then the air is mixed into the tube to generate the bubble in some cases, and/or the solvent of the ink contained in the tube is evaporated to increase the viscosity of the ink in other cases. If the bubble and the viscosity-increased ink contained in the tube as described above are fed to the head, then the abnormality (for example, the nozzle-absence by which the ink droplets are not jetted, or the jetting-curvature by which the ink droplets are not jetted in the right direction) arises in the liquid droplet jetting performed with the nozzle by the head, and the printing quality is deteriorated.

However, in Japanese Patent Application Laid-open Nos. 5-57905, 10-157161, and 2004-188647, the detecting means, which detects the presence or absence of the ink in the tube, the concentration, and/or the presence or absence of the bubble, has the fixed position with respect to the tube. The detecting means can detect only the state of the ink at a certain portion of the tube. Therefore, if the bubble passes through the predetermined detection position by some chance during the period in which the state of the ink in the tube is not detected (for example, during the period in which the power source is turned OFF), it is feared that the bubble may thereafter arrive at the head without being detected.

Further, in Japanese Patent Application Laid-open Nos. 5-57905, 10-157161, and 2004-188647, it is impossible to recognize at what position the bubble and/or the viscosity-increased ink exists in the tube extending over a long distance from the head to the tank, and it is of course impossible to recognize the size of the bubble and the extent of the viscosity increase. Therefore, it is impossible to optimize the discharge operation depending on, for example, the size of the bubble if it is intended to discharge the bubble from the ink supply system ranging to the head by means of any discharge means until the bubble or the like arrives at the head when the detecting means detects the bubble and/or the viscosity-increased ink contained in the tube. For example, the following problems arise. That is, a large amount of the ink (normal ink not subjected to the viscosity increase) is discharged together with the bubble or the like during the discharge operation for discharging the bubble or the like. In another situation, the discharge operation is performed for an unnecessarily long period of time.

SUMMARY OF THE INVENTION

An object of the present invention is to provide a liquid droplet jetting apparatus which is capable of detecting a state of a liquid at a plurality of positions of a tube.

According to the first aspect of the present invention, there is provided a liquid droplet jetting apparatus which jets liquid droplets of a liquid onto a medium, including:

a liquid droplet jetting head which jets the liquid droplets;

a storage tank which stores the liquid to be jetted by the liquid droplet-jetting head;

a tube which connects the liquid droplet jetting head and the storage tank; and a liquid-state detecting mechanism which detects a state of the liquid contained in the tube at a plurality of positions in a longitudinal direction of the tube.

According to the present invention, the state of the liquid in the tube (for example, bubble and/or viscosity-increased liquid) is detected at the plurality of positions by means of the liquid-state detecting mechanism. Therefore, the opportunity is increased to detect the bubble and/or the viscosity-increased liquid existing in the tube, and the reliability of the detection is enhanced. Further, it is possible to grasp not only the presence or absence of the bubble and/or the viscosity-increased liquid in the tube but also the position and the amount of the bubble and/or the viscosity-increased liquid. Therefore, the amount of the liquid to be discharged (wasted or discarded) can be suppressed to be small, for example, by optimally controlling the discharge operation for the bubble and/or the viscosity-increased liquid on the basis of the information about the position and the amount of the bubble and/or the viscosity-increased liquid.

BRIEF DESCRIPTION OF THE DRAWINGS

FIGS. 5A and 5B illustrate the bubble detection in a tube, wherein FIG. 5A shows a state in which a bubble exists in the tube, and FIG. 5B shows the output change of the sensor in the state shown in FIG. 5A.

FIGS. 6A and 6B illustrate the viscosity-increased ink detection in a tube, wherein FIG. 6A shows a state in which a viscosity-increased ink exists in the tube, and FIG. 6B shows the output change of the sensor in the state shown in FIG. 6A.

FIGS. 11A and 11B show a tube according to a second modified embodiment, wherein FIG. 11A shows a sectional view, and FIG. 11B shows a perspective view illustrating a tube structure in which those corresponding to four colors are integrated into one unit.

FIGS. 12A and 12B show an ink state detection sensor according to a fourth modified embodiment, wherein FIG. 12A shows a state provided when an end position is detected, and FIG. 12B shows a state provided when an ink state in a tube is detected.

FIGS. 16A and 16B show a tube and a sensor holding member according to a ninth modified embodiment, wherein FIG. 16A shows a sectional view illustrating the tube, and FIG. 16B shows a perspective view.

DESCRIPTION OF THE PREFERRED EMBODIMENTS

Figure 1:
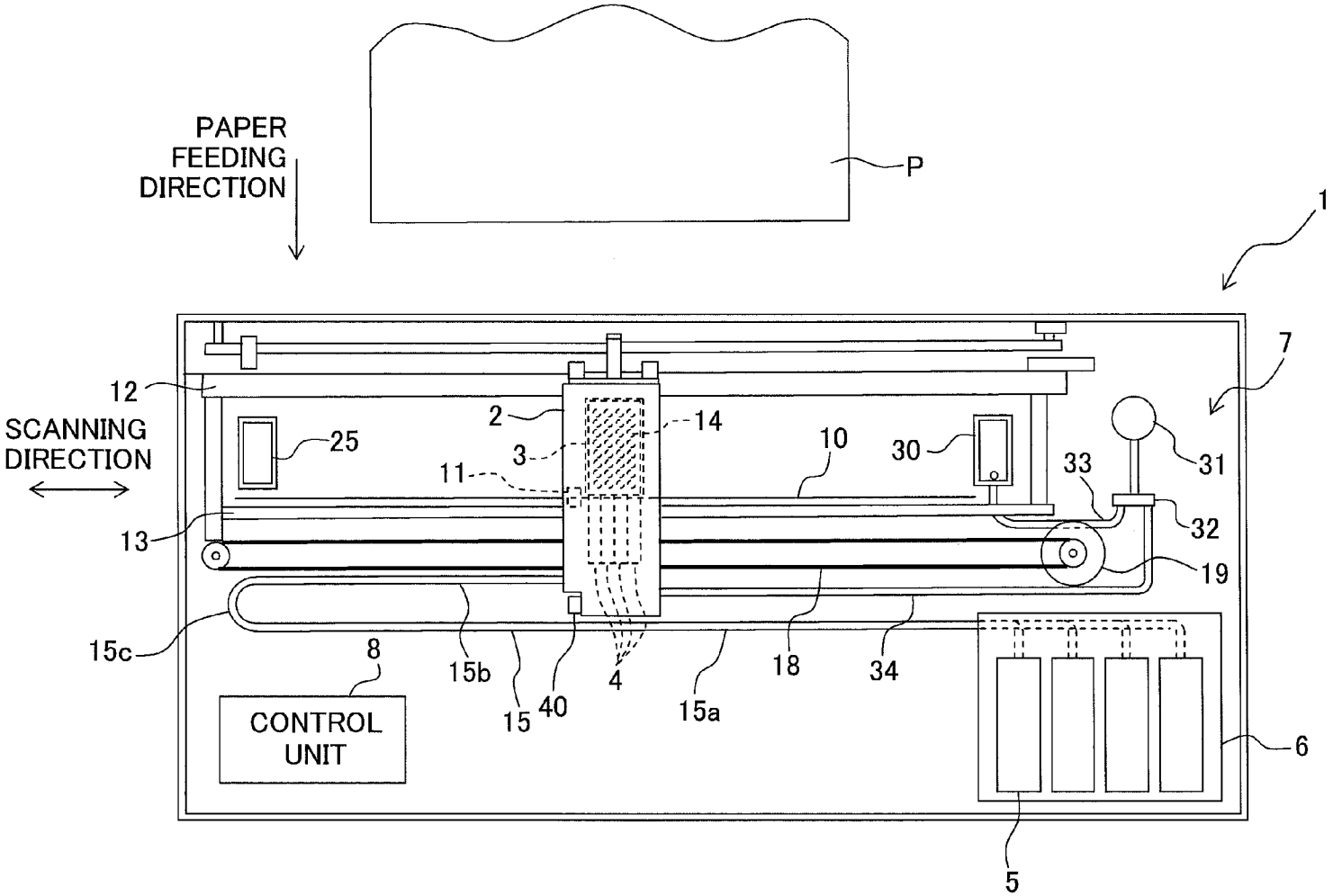
FIG. 1 shows a plan view schematically illustrating a printer according to an embodiment of the present invention.

Next, an embodiment of the present teaching will be explained. As shown in FIG. 1, a printer 1 (liquid droplet jetting apparatus) includes a carriage 2 which is constructed reciprocatively movably in the scanning direction as shown in FIG. 1, an ink jet head 3 (liquid droplet jetting head) and subtanks 4 which are carried on the carriage 2, a holder 6 to which ink cartridges 5 (storage tanks) for storing inks are installed, a purge mechanism 7 which discharges, for example, any bubble existing in the ink supply system of the ink-jet head 3, and a control unit 8 which controls respective sections of the printer 1.

The carriage 2 is constructed reciprocatively movably along two guide rails 12, 13 extending in parallel in the left-right direction (scanning direction) as shown in FIG. 1. An endless belt 18 is connected to the carriage 2. When the endless belt 18 is driven to travel by a carriage driving motor 19 (moving driving mechanism), the carriage 2 is moved in the scanning direction in accordance with the travel of the endless belt 18. The printer 1 is provided with a linear encoder 10 having a large number of light transmitting portions (slits) which are arranged while providing spacing distances in the scanning direction. On the other hand, the carriage 2 is provided with a position detection sensor 11 including a transmission type photosensor having a light-emitting element and a light-receiving element. The printer 1 is constructed so that the present position of the carriage 2 in the scanning direction can be recognized from a counted value (number of times of detection) of the light transmitting portions of the linear encoder 10 detected by the position detection sensor 11 during the movement of the carriage 2.

The ink-jet head 3 and the four subtanks 4 are carried on the carriage 2. A plurality of liquid droplet jetting nozzles 14 are formed on the lower surface of the ink-jet head 3 (surface disposed on the back side in relation to the plane of paper (the paper surface) in FIG. 1). In FIG. 1, the nozzles 14 are shown while being enlarged as compared with actual diameters of the nozzles 14 so that the nozzles 14 can be viewed with ease. As shown in FIG. 1, the four subtanks 4 are arranged and aligned in the scanning direction above the ink-jet head 3. The four subtanks 4 are connected to the holder 6 respectively by means of four tubes 15 connected to the carriage 2.

Figure 3:
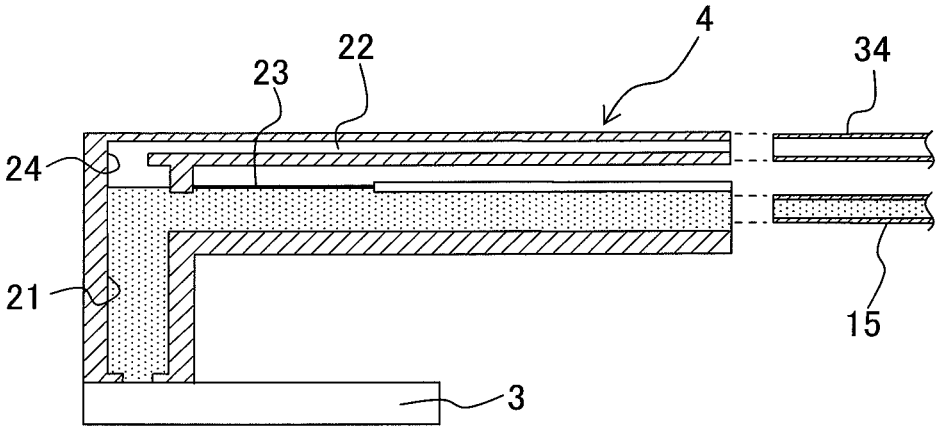
FIG. 3 shows a sectional view illustrating a subtank.

As shown in FIG. 3, a damper chamber 20, an ink supply channel 21, and a gas discharge channel 22 are formed in each of the subtanks 4. The damper chamber 20 is formed to have a shape which is spread horizontally. A damper film 23, which is composed of a flexible film, is provided at an upper wall portion thereof. The ink, which is supplied from the tube 15, is temporarily stored in the damper chamber 20. When any pressure fluctuation is caused in the ink contained in the damper chamber 20, the flexible damper film 23 functions to damp or attenuate the pressure fluctuation.

The damper chamber 20 is communicated with an upper end portion of the ink supply channel 21 extending in the vertical direction. A lower end portion of the ink supply channel 21 is connected to the ink-jet head 3. The ink is supplied from the damper chamber 20 via the ink supply channel 21 to the ink-jet head 3. The ink supply channel 21 also plays such a role that the bubble, which flows into the subtank 4 together with the ink from the tube 15, is separated from the ink so that the bubble is stored (bubble storage member of the present invention). Specifically, a space 24 is defined on the upper side of the ink supply channel 21 as compared with the communication port with respect to the damper chamber 20. Therefore, the bubble, which is mixed in the ink supplied from the damper chamber 20 to the ink supply channel 21, is trapped by the space 24, and the bubble is progressively stored. A gas discharge channel 22, which is communicated with the space 24 and through which the bubble stored in the space 24 is discharged, is connected to the ceiling surface of the ink supply channel 21. Further, the gas discharge channel 22 is connected to a suction pump 31 of a purge mechanism 7 as described later on.

Figure 2:
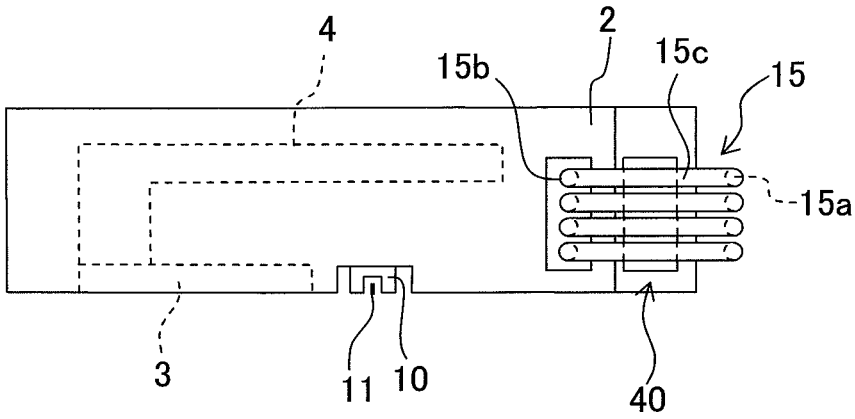
FIG. 2 shows a side view illustrating a carriage shown in FIG. 1 as viewed from the left side of FIG. 1.

As shown in FIG. 1, the holder 6 and the four subtanks 4 of the carriage 2 are connected to one another by means of the four tubes 15. The four tubes 15 are composed of a light-transmissive synthetic resin material such as polyimide. Further, the four tubes 15 are bendable because they have the flexibility. As shown in FIG. 2, the four tubes 15 are arranged while being aligned in the up-down direction. As shown in FIG. 1, each of the tubes 15 is connected at one end thereof to the left side surface of the carriage 2. Each of the tubes 15 is led out leftwardly (toward one side in the scanning direction) from the carriage 2, and then each of the tubes 15 is bent and inverted so that each of the tubes 15 is laid out rightwardly (toward the other side in the scanning direction). The other end of each of the tubes 15 is connected to the holder 6. An ink-state detection sensor 40, which detects the state of the ink contained in a tube portion 15*a*, is provided opposingly to the tube portion 15*a* of the tube 15 which is bent, inverted, and connected to the holder 6, on the left side surface of the backward end portion of the carriage 2 (end portion disposed on the downstream side in the paper feeding direction). The ink-state detection sensor 40 will be described in detail later on.

The four ink cartridges 5, which store the inks of four colors (black, yellow, cyan, and magenta) respectively, are removably installed to the holder 6. The four color inks, which are stored in the four ink cartridges 5 respectively, are supplied to the four subtanks 4 via the four tubes 15. The four color inks are temporarily stored in the subtanks 4, and then the color inks are supplied to the ink-jet head 3.

Figure 7:
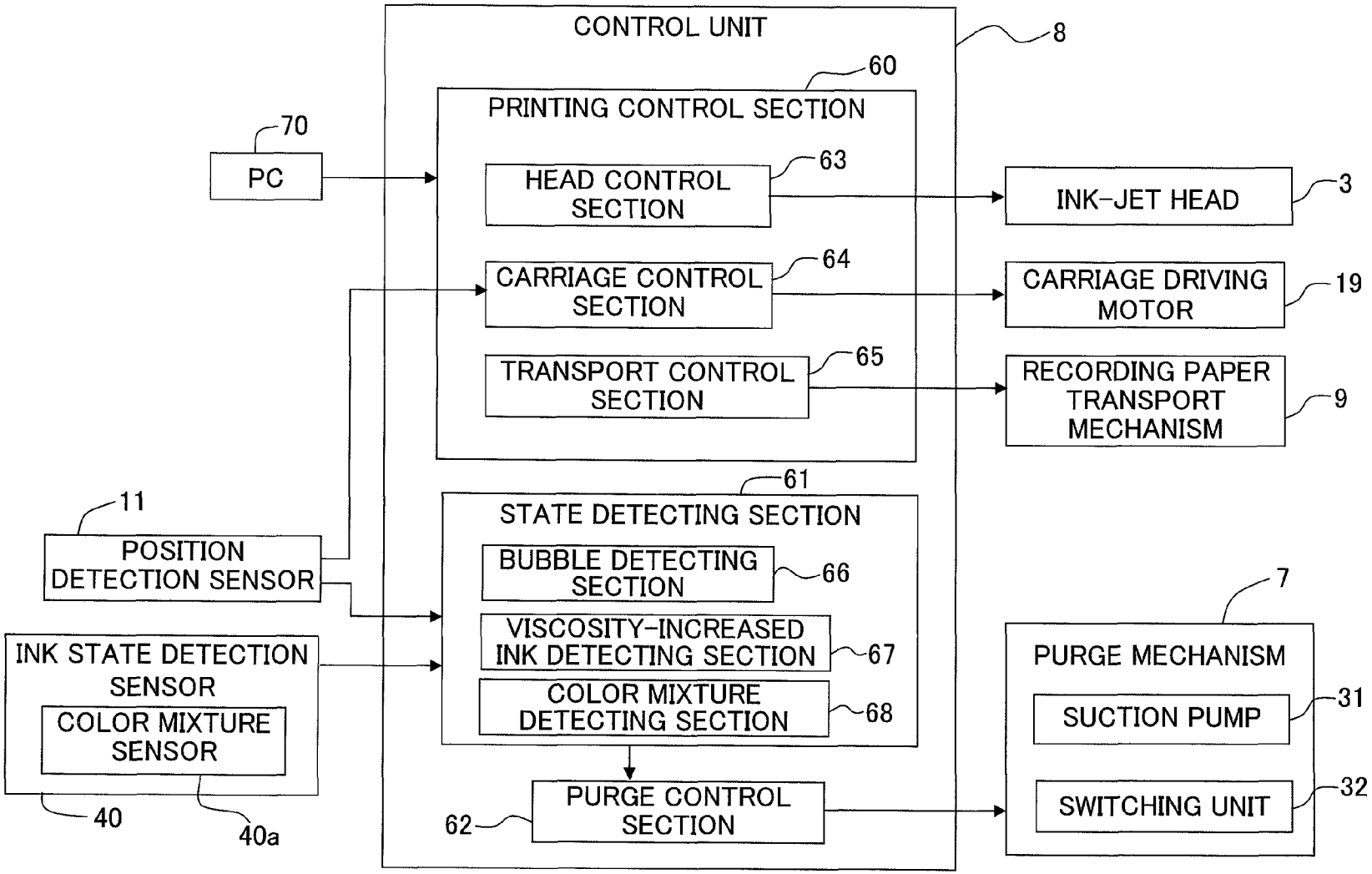
FIG. 7 shows a block diagram illustrating an electrical arrangement of the printer.

In the printer 1 as described above, the recording paper P is fed from the upper position as viewed in FIG. 1 to the position disposed on the lower side of the ink jet head 3 (back side in relation to the plane of the paper in FIG. 1) by means of a transport mechanism 9 of the recording paper having a plurality of transport rollers for the recording paper (transport mechanism, see FIG. 7, omitted from the illustration in FIG. 1). The ink-jet head 3 jets the ink liquid droplets onto the recording paper P from the plurality of nozzles 14 provided on the lower surface of the ink jet head 3, while performing the reciprocative movement in the scanning direction together with the carriage 2. Accordingly, a desired image and letters are recorded on the recording paper P. In the printer 1 shown in FIG. 1, the transport direction, in which the recording paper P is transported by the transport mechanism 9, is perpendicular to the scanning direction of the carriage 2. However, the present teaching is not limited thereto. It is not necessarily indispensable that the transport direction should be perpendicular to the scanning direction provided that the transport direction intersects the scanning direction.

As shown in FIG. 1, the purge mechanism 7 is arranged at the position disposed at the outside (on the right side as shown in FIG. 1) of the printing area in relation to the scanning direction, the printing area facing the recording paper P within the range of movement of the carriage 2. A storage cap 25 is provided at the position disposed at the outside of the printing area on a side opposite to the purge mechanism 7 (on the left side as shown in FIG. 1), with the printing area intervening therebetween. The storage cap 25 is installed to the ink jet head 3 so that the nozzles 14 are covered therewith in order to avoid the drying of the inks from the nozzles 14 when the ink-jet head 3 stops.

In the printer 1 of the embodiment of the present teaching, when any bubble is mixed into the ink to be jetted by the ink-jet head 3, or when the solvent of the ink is evaporated to increase the viscosity, then the malfunction, which includes, for example, the nozzle-absence and the jetting-curvature, is caused in the ink-jet head 3. Accordingly, the purge mechanism 7 is provided with a mechanism to discharge the viscosity-increased ink and the bubble mixed into the ink which cause the malfunction of the ink jet head 3 as described above.

Specifically, the purge mechanism 7 has a suction cap 30, a suction pump 31, and a switching unit (changeover unit) 32. The suction cap 30 is constructed movably in the up-down direction (direction perpendicular to the plane of the paper in FIG. 1). The plurality of nozzles 14, which are disposed on the lower surface of the ink jet head 3, can be covered therewith by moving the suction cap 30 upwardly in a state in which the carriage 2 is opposed to the suction cap 30.

The suction pump 31 is connected to the switching unit 32. Further, the switching unit 32 is connected to the suction cap 30 via a suction tube 33. The switching unit 32 is also connected to the gas discharge channels 22 of the subtanks 4 (see FIG. 3) via a gas discharge tube 34. The switching unit 32 switches the connection/disconnection between the suction cap 30 and the suction pump 31, and the connection/disconnection between the subtanks 4 and the suction pump 31 respectively.

When the suction pump 31 is operated in a state in which the suction cap 30 covers the nozzles 14 of the ink jet head 3 and the suction cap 30 is connected to the suction pump 31 by means of the switching unit 32, then the inks can be sucked from the nozzles 14, and it is possible to perform the suction purge so that the bubbles and the viscosity-increased ink contained in the ink-jet head 3 are discharged. On the other hand, when the suction pump 31 is operated in a state in which the subtanks 4 is connected to the suction pump 31 by means of the switching unit 32, it is possible to perform the gas discharge purge so that the bubbles stored in the subtanks 4 are discharged from the gas discharge channels 22.

By the way, the phenomenon of the mixing of bubbles and/or the viscosity increase of the ink, which causes the jetting malfunction in the ink-jet head 3, is often caused by the tubes 15 for connecting the carriage 2 and the holder 6. For example, when the ink cartridge 5 is installed or removed with respect to the holder 6, then the air makes invasion from the connecting portion between the holder 6 and the ink cartridge 5 in some cases, and the air enters the tube 15 to form the bubble. Further, the tube 15, which is composed of the synthetic resin material, has the gas permeability. Therefore, the invasion of the air into the tube 15 and the evaporation of the ink contained in the tube 15 proceed, although the invasion and the evaporation proceed gradually. Therefore, when the state, in which the printer 1 is not used, is continued for a long period of time, the bubble contained in the tube 15 greatly grows. In another situation, the degree of viscosity increase of the ink becomes serious in the tube 15.

As shown in FIG. 1, the printer of the embodiment of the present invention is provided with the ink-state detection sensor 40 (liquid-state detecting mechanism) which detects the state of the ink contained in the tube 15 (presence or absence of any bubble and/or any viscosity-increased ink). The suction purge and the gas discharge purge can be performed by the purge mechanism 7 only when they are required, on the basis of the detection result of the sensor 40. However, in order to perform the purge by the purge mechanism 7 more efficiently, it is preferable to successfully detect at what position the bubble and/or the viscosity-increased ink exists in the tube 15, and it is preferable to successfully detect the extent of the size (amount) of the bubble and/or the viscosity-increased ink existing in the tube 15. The ink-state detection sensor 40 of the embodiment of the present teaching is movable in the longitudinal direction of the tube 15 (an extending direction along the tube). Therefore, the state of the ink contained in the tube 15 can be detected by the sensor 40 at a plurality of positions in the longitudinal direction of the tube 15. Further, the state of the ink (the ink-state) can be detected continuously in the longitudinal direction. Accordingly, it is possible to detect the position and the size of the bubble and/or the viscosity-increased ink.

Figure 4:
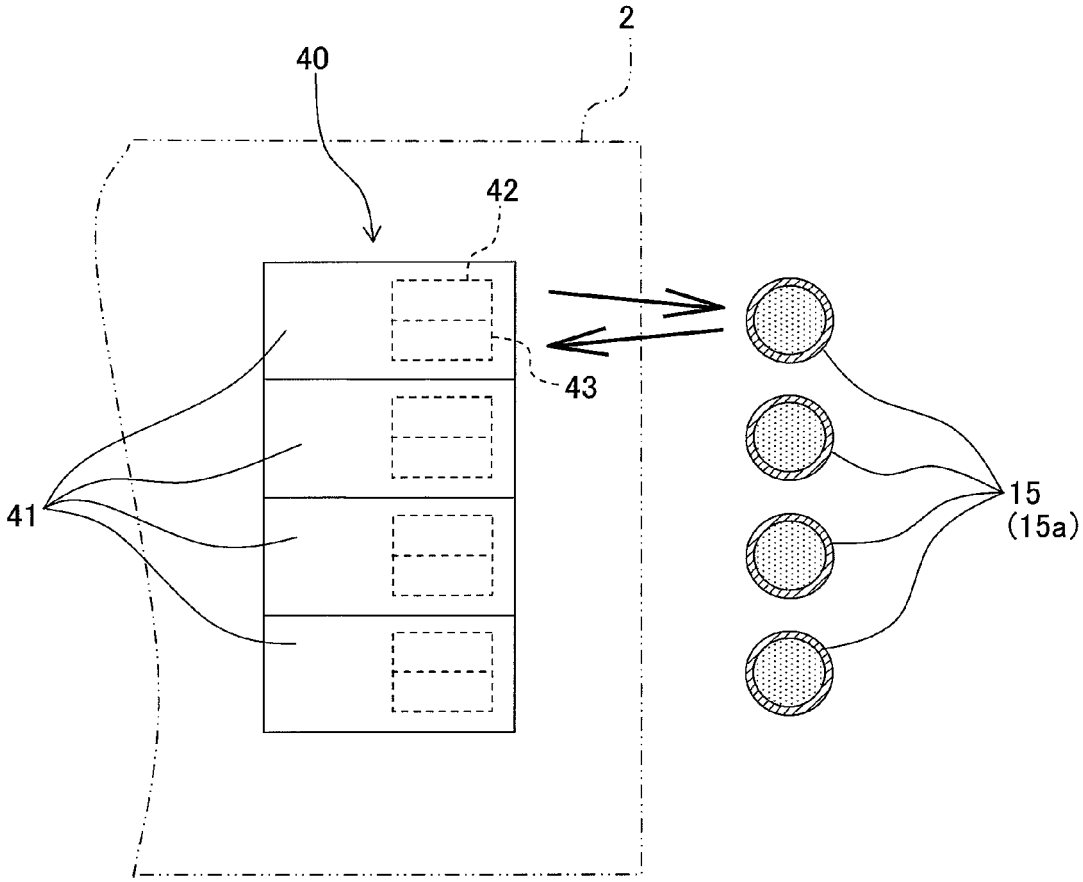
FIG. 4 shows an enlarged view illustrating an ink state detection sensor shown in FIG. 2.

An arrangement of the ink-state detection sensor 40 will be specifically explained below. As shown in FIGS. 1, 2, and 4, the ink-state detection sensor 40 is provided on the carriage 2 which is reciprocatively driven in the scanning direction by the carriage driving motor 19 (movement-driving mechanism). As shown in FIG. 1, the tubes 15, which are connected to the ink-jet head 3 carried on the carriage 2, are led out leftwardly (toward one side in the scanning direction), and then the tubes 15 are bent and inverted so that the tubes 15 are laid out rightwardly (toward the other side in the scanning direction) and the tubes 15 are connected to the holder 6. In other words, the tube portions 15*a*, which range from the bent and inverted portions 15*c* to the holder 6, are arranged in the scanning direction on the downstream side in the paper feeding direction as compared with the carriage 2. On this condition, the ink-state detection sensor 40 is movable in the scanning direction together with the carriage 2 while being opposed to the tube portions 15*a*.

The second tube portions 15*b* of the tubes 15, which range to the bent and inverted portions 15*c* and which are directly connected to the ink-jet head 3, are moved in the scanning direction in accordance with the movement of the carriage 2. On the contrary, the first tube portions 15*a* of the tubes 15, which range from the bent and inverted portions 15*c* to the holder 6, are scarcely moved, because the position of the holder 6 is fixed. Therefore, when the ink state detection sensor 40 is moved in the scanning direction together with the carriage 2, the ink-state detection sensor 40 is relatively moved in the longitudinal direction of the tubes 15 with respect to the first tube portions 15*a*.

As shown in FIG. 4, the ink-state detection sensor 40 is provided with four photosensors 41 which individually detect the states of the respective inks of the four tubes 15. As also shown in FIGS. 2 and 4, the four tubes 15 are arranged while being aligned in the up-down direction on the side of the carriage 2. Therefore, the four photosensors 41, which correspond to the four tubes 15, are also arranged while being aligned in the up-down direction. Each of the photosensors 41 is a reflection type photosensor having a light-emitting element 42 and a light-receiving element 43 which are arranged closely to one another at positions opposed to the tube 15. The light is emitted from the light-emitting element 42 toward the tube 15 as the objective, and the light reflected by the ink contained in the tube 15 is received by the light-receiving element 43.

As described above, the tube 15 is formed of the light-transmissive synthetic resin material. The light, which is emitted from the light-emitting element 42, is firstly transmitted through the wall of the tube 15 disposed on the side of the carriage 2. If any bubble is not present in the tube 15, then a part of the light is reflected by the ink, and the part of the light is received by the light-receiving element 43. On the contrary, if any bubble is present, the light is hardly reflected. Therefore, the light is not reflected by the interior of the tube 15, and a large amount of the light is transmitted through the tube 15 as compared with the case in which the bubble is absent. Therefore, if any bubble is present, the light-receiving amount of the light-receiving element 43 is decreased. On the other hand, if any viscosity-increased ink is present in the tube 15, then the concentration of the viscosity-increased ink is higher than that of the ink having the ordinary viscosity, the viscosity-increased ink has the lower light-transmissive property, and the light reflected by the viscosity-increased ink is increased. Therefore, if any viscosity-increased ink is present, the light-receiving amount of the light-receiving element 43 is increased.

The ink-state detection sensor 40 can be moved in the longitudinal direction of the tube 15. Therefore, it is possible to detect not only the presence or absence of the bubble and/or the viscosity-increased ink but also the position and the size (amount) thereof. Further, not only the light-transmissive property (reflectance) differs but the refractive index also differs between the viscosity-increased ink and the ink having the ordinary viscosity. Accordingly, the present teaching is not limited to only the utilization of the difference in the light-transmissive property between the viscosity-increased ink and the ink having the ordinary viscosity. It is also allowable to detect the position and the size of the viscosity-increased ink by utilizing the difference in the refractive index between the viscosity-increased ink and the ink having the ordinary viscosity.

Figure 5A:
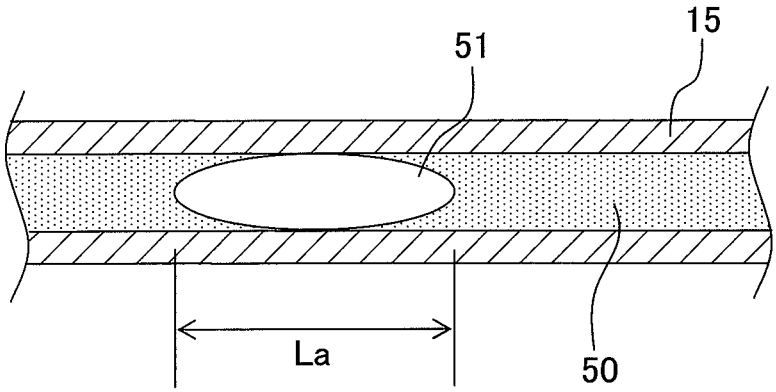
Figure 5B:
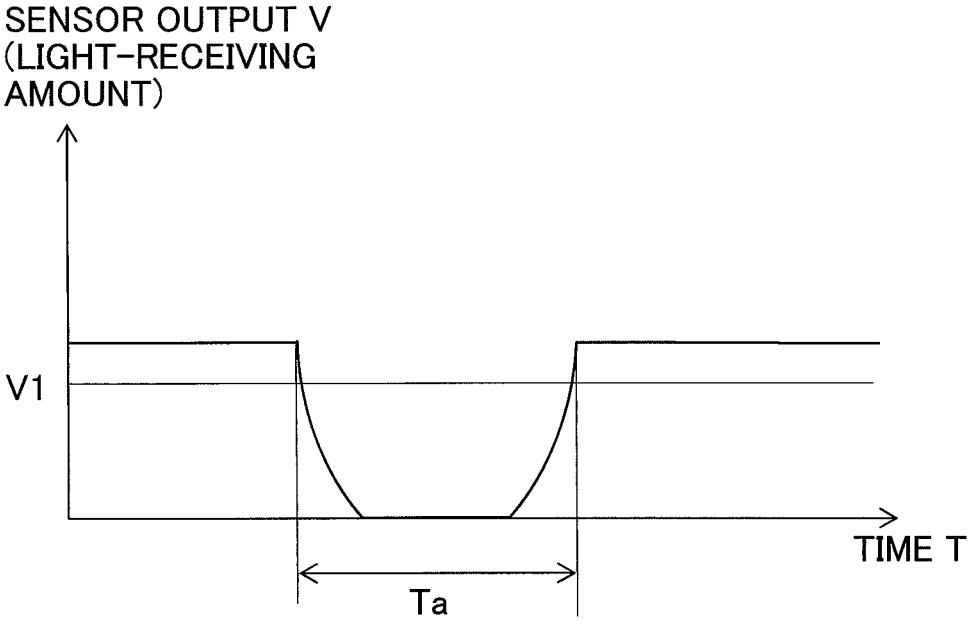

As shown in FIG. 5A, a situation is assumed, in which the bubble 51 exists in the ink 50 in a range La having a certain length in the tube 15. In this situation, the ink-state detection sensor 40, which is moved at a predetermined velocity in the scanning direction (longitudinal direction of the tube 15), provides the output (light amount received by the light-receiving element 43; light-receiving amount of the light-receiving element 43) which is decreased during a time Ta of the light emission from the light-emitting element 42 in an interval of the range La as shown in FIG. 5B. Therefore, the length of the range La of the presence of the bubble 51, i.e., the size of the bubble 51 can be detected from the velocity of movement of the sensor 40 (scanning velocity of the carriage 2) and the time Ta in which the output is decreased as compared with a predetermined first threshold value V1. The position in the scanning direction of the carriage 2 has been detected by the position detection sensor 11. Therefore, it is also possible to detect the position of existence of the range La in the tube 15. It is noted that the detection of the presence or absence of the bubble 51, the position of the bubble, and the size of the bubble is performed by a bubble detecting section 66 of the control unit 8 as described later on, on the basis of the detection signal of the ink-state detection sensor 40.

Figure 6A:
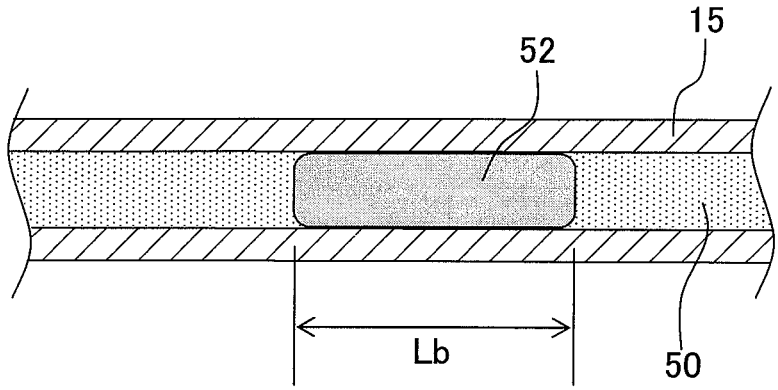
Figure 6B:
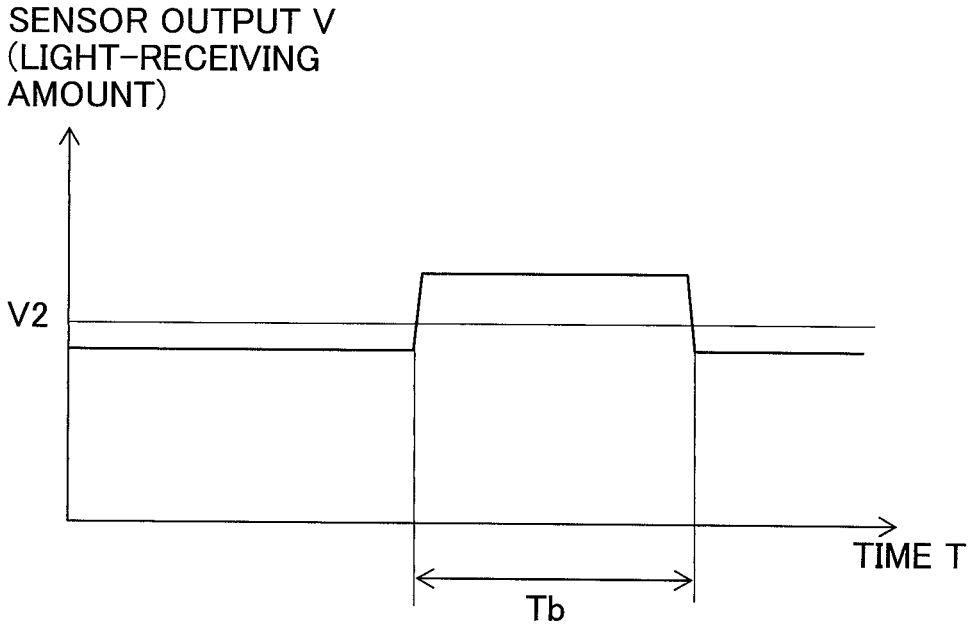

As shown in FIG. 6A, a situation is assumed, in which the viscosity-increased ink 52, which has the viscosity higher than that of the ink 50, exists in the ink 50 having the ordinary viscosity in a range Lb having a certain length in the tube 15. In this situation, the ink-state detection sensor 40 provides the output which is increased during a time Tb of the light emission from the light-emitting element 42 in an interval of the range Lb as shown in FIG. 6B. Therefore, the length of the range Lb of the presence of the viscosity-increased ink 52, i.e., the amount of the viscosity-increased ink 52 can be detected from the velocity of movement of the sensor 40 and the time Tb in which the output is increased as compared with a predetermined second threshold value V2 (>first threshold value V1) in the same manner as in the bubble detection described above. Further, the degree of the increase in viscosity can be also detected from the output value (magnitude of the light-receiving amount). Further, it is also possible to detect the position of existence of the range Lb in the tube 15 from the position of the carriage 2 detected by the position detection sensor 11. It is noted that the detection of the presence or absence of the viscosity-increased ink, the position of the viscosity-increased ink, the amount of the viscosity-increased ink, and the degree of the increase in viscosity is performed by a viscosity-increased ink detecting section 67 of the control unit 8 as described later on, on the basis of the detection signal of the ink-state detection sensor 40.

Therefore, it is possible to detect not only the presence or absence of the bubble and/or the viscosity-increased ink in the tube 15 but also the position and the size (amount) thereof. Therefore, it is possible to optimize the suction purge and the gas discharge purge performed by the purge mechanism 7 so that only a necessary amount of the ink is discharged when the discharge is required, on the basis of the information in relation to the bubble and/or the viscosity-increased ink as described above. This feature will be described in detail in the explanation of the purge control described later on.

FIGS. 5B and 6B are illustrative of the exemplary cases in which the light is continuously emitted by the light-emitting element 42 and the light is continuously received by the light-receiving element 43 during the period in which the sensor 40 is moved so that the state of the ink is continuously detected by the sensor 40 in the longitudinal direction of the tube 15. However, the present teaching is not limited thereto. The light may be intermittently emitted by the light-emitting element 42 and/or the light may be intermittently received by the light-receiving element 43 at every predetermined time intervals. Accordingly, the ink-state may be detected at every predetermined intervals in the longitudinal direction of the tube 15. However, in order to accurately detect the position and the size of the bubble 51 and/or the viscosity-increased ink 52, it is of course preferable to perform the detection continuously in the longitudinal direction of the tube 15.

The light, which is emitted by the light-emitting element 42, is basically the white light. However, the light amount and/or the wavelength of the light emitted by the light-emitting element 42 may differ depending on the color of the ink contained in the tube 15 subjected to the detection. The first threshold value V1 for the bubble detection and the second threshold value V2 for the viscosity-increased ink detection described above are individually set respectively depending on the color of the ink contained in the tube 15 subjected to the detection.

Next, an explanation will be made in detail with reference to a block diagram shown in FIG. 7 about the control system of the ink-jet printer 1 composed of the control unit 8 as a main component. The control unit 8 of the printer 1 shown in FIG. 7 is provided with a microcomputer including, for example, Central Processing Unit (CPU), Read Only Memory (ROM) which stores therein, for example, various programs and data for controlling the overall operation of the printer 1, and Random Access Memory (RAM) which temporarily stores therein, for example, data to be processed by the CPU. The programs stored in ROM are executed by CPU to thereby perform various types of control as explained below. Alternatively, the control unit 8 may be composed of a hardware in which various circuits including a computing circuit are combined.

The control unit 8 includes a printing control section 60, a state detecting section 61, and a purge control section 62. The respective functions of the printing control section 60, the state detecting section 61, and the purge control section 62 explained below are actually realized by the operation of the microcomputer described above or the operation of various circuits including the computing circuit.

The printing control section 60 has a head control section 63 which controls the liquid droplet jetting operation of the ink jet head 3, a carriage control section 64 which controls the carriage driving motor 19 on the basis of the output of the position detection sensor 11 to control the position of the carriage 2 in the scanning direction, and a transport control section 65 which controls the transport operation of the recording paper in the transport mechanism 9. The printing control section 60 performs the printing on the recording paper P by controlling the ink-jet head 3, the carriage driving motor 19, and the transport mechanism 9 on the basis of the data (printing data) which is inputted from PC 70 and which relates, for example, to an image to be printed.

The state detecting section 61 has a bubble detecting section 66 and a viscosity-increased ink detecting section 67. The bubble detecting section 66 (bubble-detecting mechanism) detects the presence or absence of the bubble, the position of the bubble, and the size of the bubble for each of the four tubes 15 on the basis of the detection signal of the ink-state detection sensor 40 (change of the light-receiving amount) and the position information of the carriage 2 detected by the position detection sensor 11. Similarly, the viscosity-increased ink detecting section 67 (viscosity-increased liquid detecting mechanism) detects the presence or absence of the viscosity-increased ink, the position of the viscosity-increased ink, the size (amount) of the viscosity-increased ink, and the degree of the viscosity increase for each of the four tubes 15.

The purge control section 62 (bubble discharge control mechanism, liquid discharge control mechanism) performs the suction purge and the gas discharge purge by controlling the suction pump 31 (bubble discharge mechanism, viscosity-increased liquid discharge mechanism) on the basis of the information about the bubble and the viscosity-increased ink detected by the state detecting section 61 so that the bubble and the viscosity-increased ink are efficiently discharged.

Each of the timing at which the ink-state detection sensor 40 described above detects the state of the ink (timing at which the ink-state detection sensor 40 is subjected to the scanning), the timing at which the bubble and the viscosity-increased ink are detected on the basis thereof, and the timing at which the purge is performed on the basis of the detection result, is not limited to any specified timing. The timings may be appropriately set. However, when the state, in which the printing is not performed, is continued for a long period of time, the possibility is raised for the presence of the bubble and the viscosity-increased ink in the tube 15. Therefore, it is effective to perform the operation, for example, immediately after the power source is turned ON. Alternatively, when the degree of time elapse from the previous printing can be recognized, for example, by an internal clock or timer contained in the printer 1, the detection of the bubble or the like and the purge may be performed at an appropriate timing determined on the basis thereof.

Of course, it is also allowable to appropriately perform the foregoing detection during the period in which the power source of the printer 1 is turned ON. For example, when the printing instruction (printing data) is inputted from PC 70, the detection may be performed immediately before the printing so that any harmful influence is not exerted on the printing by the bubble and the viscosity-increased ink. In this way, the bubble and the viscosity-increased ink may be reliably discharged by means of the purge.

Next, an explanation will be made below as exemplified by a specified example while being classified into the case in which the bubble is discharged and the case in which the viscosity-increased ink is discharged, in relation to the purge control to be performed on the basis of the detection results of the bubble detecting section 66 and the viscosity-increased ink detecting section 67.

<Bubble Discharge Control>

In the bubble discharge control, if the bubble in the tube 15 is detected by the bubble detecting section 66 on the basis of the detection signal of the ink-state detection sensor 40, the purge control section 62 allows the purge mechanism 7 to perform the gas discharge purge for discharging the bubble from the subtank 4.

When the bubble discharge control is started, then the control unit 8 firstly moves the carriage 2 at a constant velocity in the scanning direction by means of the carriage driving motor 19, and the state in the tube 15 (tube portion 15*a* shown in FIG. 1) is detected (S10) while moving (scanning) the ink-state detection sensor 40 in the longitudinal direction with respect to the tube 15. Subsequently, the bubble detecting section 66 detects whether or not the bubble exists in the tube 15 from the change of the output of the ink-state detection sensor 40 (change of the light-receiving amount of the light-receiving element 43) (S11).

Figure 8:
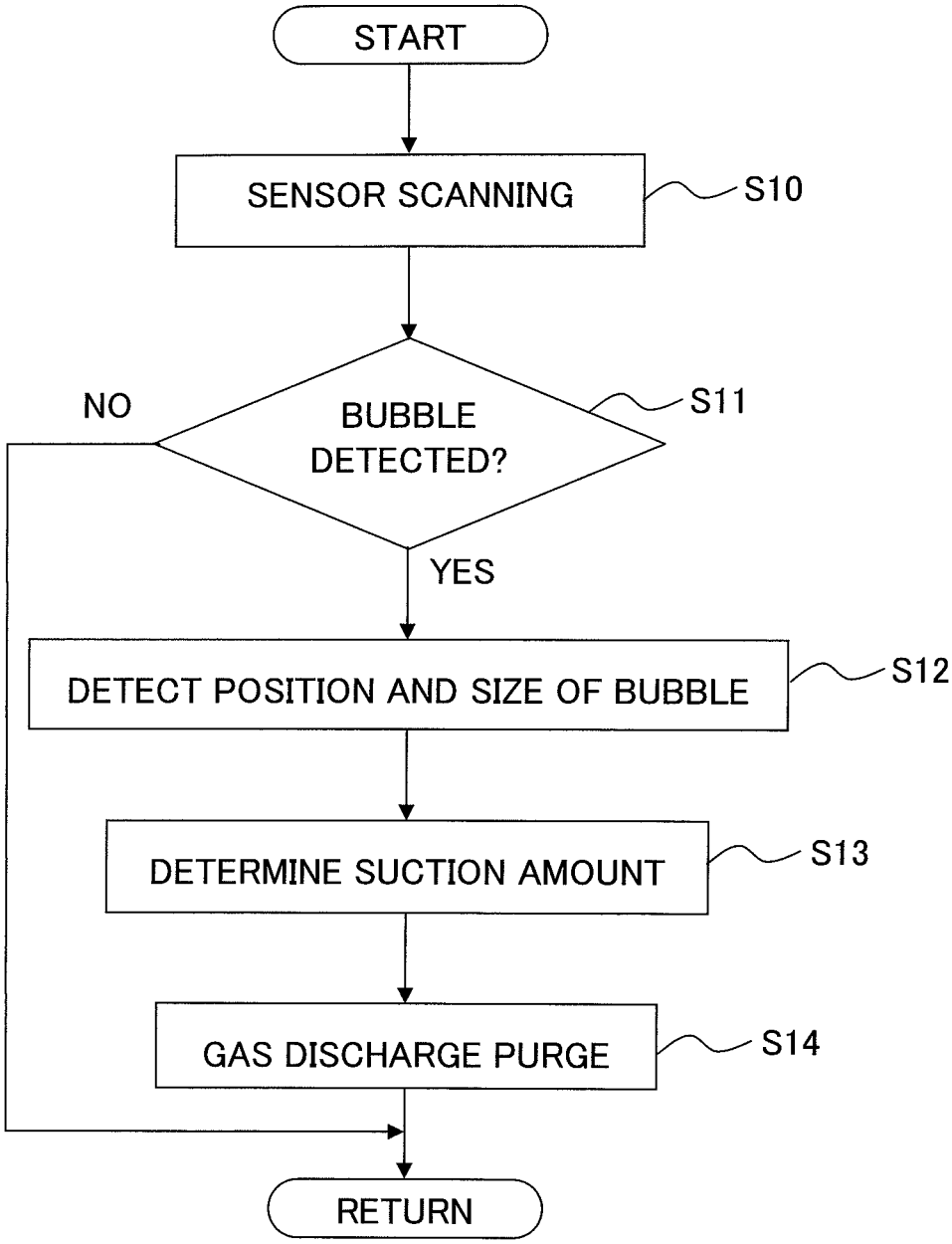
FIG. 8 shows a flow chart illustrating the bubble discharge control.

As explained with reference to FIG. 5, if the bubble exists in the tube 15, the light-receiving amount (output value) of the light-receiving element 43 is lowered. Therefore, if the light-receiving amount is lower than the predetermined first threshold value V1 which corresponds to the light-receiving amount obtained when the ink exists (time Ta shown in FIG. 5B), the bubble detecting section 66 judges that the bubble is present in the tube 15 (S11: Yes). On the other hand, if it is judged that the bubble is absent in the tube 15 (S11: No), the routine returns from the sequence shown in FIG. 8 without executing Steps S12 to S14 described later on.

When the bubble is present, the bubble detecting section 66 detects the position of the bubble in the longitudinal direction of the tube 15 from the timing at which the output of the sensor 40 is changed and the position of the carriage 2 which is provided at the timing and which is obtained by the position detection sensor 11. Further, the size of the bubble is detected from the time in which the output of the sensor 40 is changed (S12).

Subsequently, the purge control section 62 determines the optimum suction amount (minimum necessary suction amount) of the suction pump 31 when the bubble is discharged by means of the gas discharge purge on the basis of the position and the size of the bubble detected by the bubble detecting section 66 (S13). The position and the size of the bubble in the tube 15 are known. Therefore, it is possible to know the extent of the minimum suction by the suction pump 31 in order to successfully discharge the bubble contained in the tube 15 from the gas discharge channel 22 of the subtank 4 completely. That is, when the minimum necessary suction amount of the suction pump 31 is determined, then it is possible to shorten the gas discharge time, and it is possible to maximally suppress the amount of the ink discharged together with the bubble from the subtank 4 by the suction purge. After determining the suction amount, the purge control section 62 allows the connection target of the suction pump 31 to be connected to the gas discharge channel 22 of the subtank 4 by means of the switching unit 32. Further, the purge control section 62 controls the suction pump 31 so that the suction is performed in the amount determined in S13 to execute the gas discharge purge (S14).

<Viscosity-Increased Ink Discharge Control>

In the viscosity-increased ink discharge control, when the viscosity-increased ink in the tube 15 is detected by the viscosity-increased ink detecting section 67 on the basis of the detection signal of the ink state detection sensor 40, the purge control section 62 allows the purge mechanism 7 to perform the suction purge for discharging the ink from the nozzles 14 unlike the bubble discharge control described above.

When the viscosity-increased ink discharge control is started, the control unit 8 performs the detection of the state in the tube 15 (first tube portion 15*a*) (S20) while moving (scanning) the ink-state detection sensor 40 in the longitudinal direction with respect to the tube 15 together with the carriage 2. Subsequently, the viscosity-increased ink detecting section 67 detects whether or not the viscosity-increased ink exists in the tube 15 from the change of the output of the ink-state detection sensor 40 (change of the light-receiving amount of the light-receiving element 43) (S21).

Figure 9:
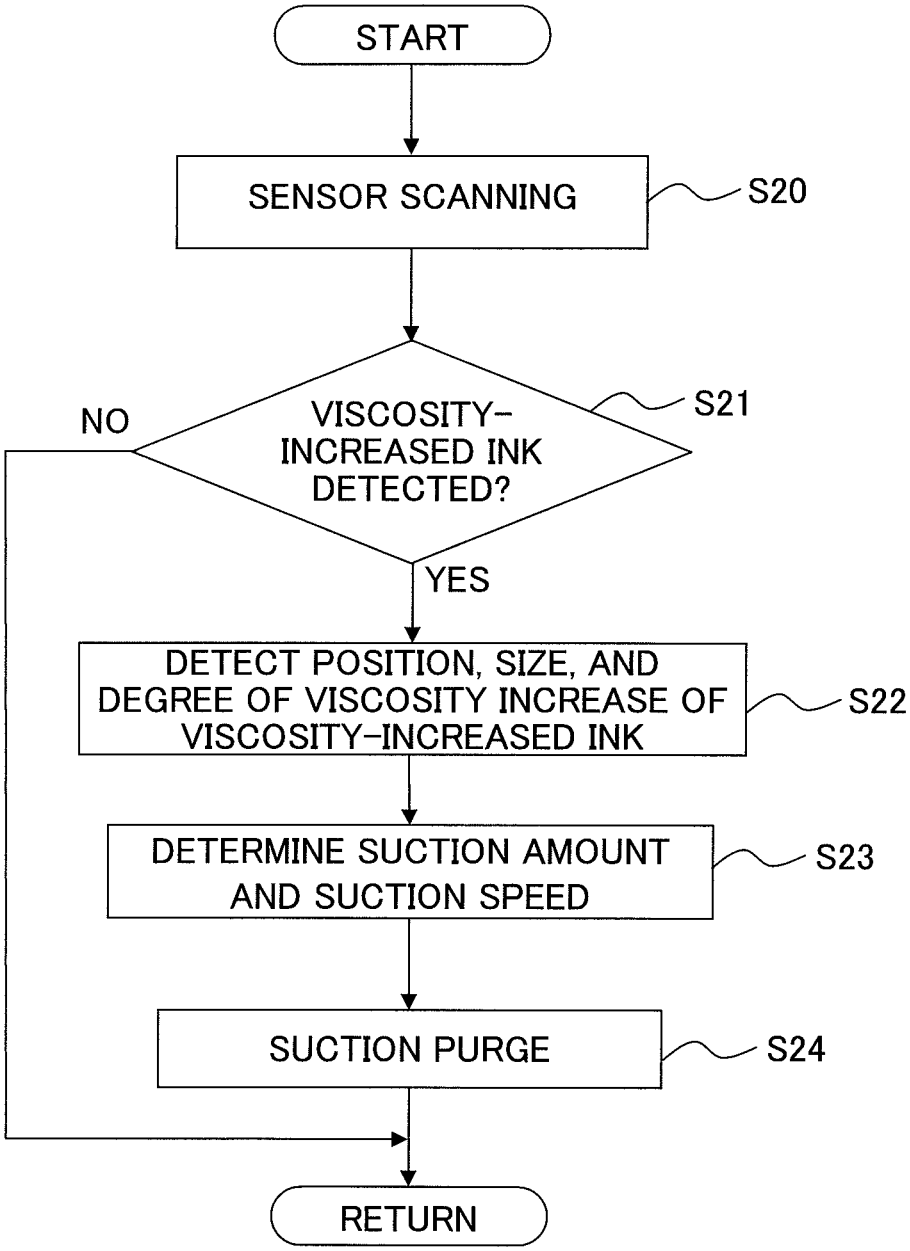
FIG. 9 shows a flow chart illustrating the viscosity-increased ink discharge control.

As explained with reference to FIG. 6, when the viscosity-increased ink exists in the tube 15, the light-receiving amount (output value) of the light-receiving element 43 is increased. Therefore, when the light-receiving amount exceeds the second threshold value V2 which corresponds to the light-receiving amount obtained when the ink, which is not subjected to the viscosity increase, exists (time Tb shown in FIG. 6B), the viscosity-increased ink detecting section 67 judges that the viscosity-increased ink is present in the tube 15 (S21: Yes). On the other hand, when it is judged that the viscosity-increased ink is absent in the tube 15 (S21: No), the routine returns from the sequence shown in FIG. 9 without executing Steps S22 to S24 described later on.

When the viscosity-increased ink is present, the viscosity-increased ink detecting section 67 detects the position of the viscosity-increased ink in the longitudinal direction of the tube 15 from the timing at which the output of the sensor 40 is changed and the position of the carriage 2 which is provided at the timing and which is obtained by the position detection sensor 11. Further, the amount of the viscosity-increased ink is detected from the time in which the output of the sensor 40 is changed. Further, the degree of the viscosity increase of the viscosity-increased ink is detected in accordance with the extent by which the output of the sensor 40 exceeds the second threshold value V2 (S22).

Subsequently, the purge control section 62 determines the optimum suction amount (minimum necessary suction amount) of the suction pump 31 and the suction speed (speed of rotation of the suction pump 31) when the viscosity-increased ink is discharged by means of the suction purge on the basis of the position and the size of the viscosity-increased ink and the degree of the viscosity increase detected by the viscosity-increased ink detecting section 67 (S23). The position and the size of the viscosity-increased ink in the tube 15 are known. Therefore, it is possible to know the extent of the minimum suction by the suction pump 31 in order to successfully discharge the viscosity-increased ink contained in the tube 15 from the nozzles 14 completely. Further, the higher the degree of the viscosity increase is, the stronger the required suction is. However, the degree of the viscosity increase is known. Therefore, it is possible to reliably discharge the viscosity-increased ink by changing the suction speed depending thereon.

After determining the suction amount, the purge control section 62 allows the connection target of the suction pump 31 to be connected to the suction cap 30 by means of the switching unit 32, and the suction cap 30 is brought in tight contact with the lower surface of the ink-jet head 3 on which the nozzles 14 are open. On this condition, the suction pump 31 is controlled so that the suction is performed in the amount and the suction speed determined in S23 to execute the suction purge (S24).

As explained above, in this embodiment, the state of the ink contained in the tube 15 (presence or absence of the bubble and/or the viscosity-increased ink) can be detected at the plurality of positions in the longitudinal direction of the tube 15, and the state of the ink contained in the tube 15 can be detected continuously in the longitudinal direction of the tube 15 by means of the ink-state detection sensor 40 which is movable in the longitudinal direction of the tube 15. Therefore, the opportunities to detect the bubble and/or the viscosity-increased ink existing in the tube are increased, and the reliability of the detection is enhanced.

The position and the size (amount) of the bubble and/or the viscosity-increased ink can be detected on the basis of the detection result of the ink-state detection sensor 40. Therefore, it is possible to shorten the period of time required for the discharge and it is possible to suppress the discharged (wasted or discarded) ink amount to be small by optimally controlling the operation (suction amount of the suction pump 31) when the suction purge and the gas discharge purge are performed to discharge the bubble and the viscosity-increased ink on the basis of the information about the position and the size of the bubble and the viscosity-increased ink.

Further, even when the bubble and/or the viscosity-increased ink is/are detected, if the size of the bubble or the viscosity-increased ink is small to such an extent that it is judged that the influence, which is exerted on the ink jet head 3, is almost absent, then it is also possible not to perform the gas discharge purge and the suction purge. For example, when the bubble is extremely small, the bubble storage amount is scarcely changed even when the bubble is absorbed by the bubble stored in the subtank 4. Therefore, no influence is exerted on the head 3. On the other hand, when the amount of the viscosity-increased ink is extremely small, no influence is exerted on the head 3 by mutually mixing the viscosity-increased ink and the ink having the ordinary viscosity disposed therearound.

In the embodiment of the present teaching, the carriage 2, on which the ink-jet head 3 is carried, is provided with the ink-state detection sensor 40. The ink-state detection sensor 40 is constructed movably in the longitudinal direction of the tube 15 integrally with the carriage 2. Therefore, it is unnecessary to distinctly provide any exclusive arrangement for moving the ink-state detection sensor 40.

The ink-state detection sensor 40 has the four photosensors 41. The four photosensors 41 are used to individually detect the states of the respective inks contained in the four tubes for supplying the four color inks to the ink jet head 3 respectively. Therefore, it is possible to perform, for example, the optimization of the gas discharge purge and the suction purge for each of the tubes 15 (i.e., for each of the ink colors).

Next, modified embodiments, in which various modifications are applied to the embodiment described above, will be explained. However, those constructed in the same manner as those of the embodiment described above are designated by the same reference numerals, any explanation of which will be appropriately omitted.

The arrangement of the ink state detection sensor 40 can be variously changed as follows.

First Modified Embodiment

Figure 10:
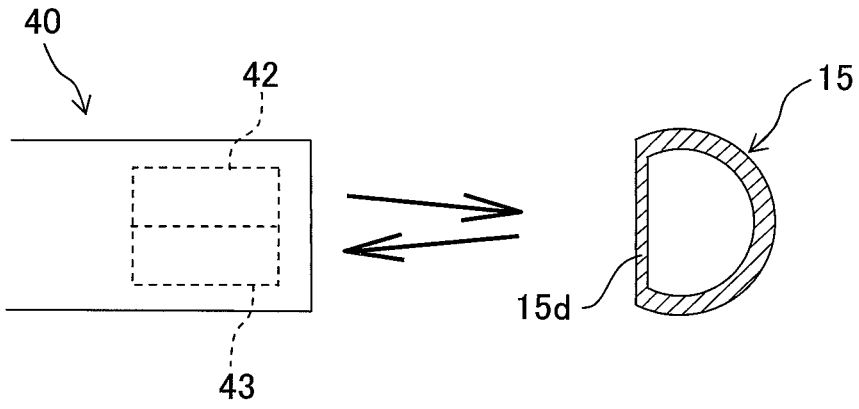
FIG. 10 shows a sectional view illustrating a tube according to a first modified embodiment.

As shown in FIG. 10, when the surface (irradiation surface) of a portion 15*d* of a tube 15, which is irradiated with the light emitted from the light-emitting element 42, is a flat surface, then the refraction of the light and the irregular reflection are decreased on the irradiation surface, and the detection accuracy of the light is raised for the light-receiving element of the sensor 40. Further, when the wall thickness of the portion 15*d* of the tube 15, which is irradiated with the light, is thinner than those of the other portions, then the portion, which is irradiated with the light emitted from the light-emitting element 42, is thinned, and the light is transmitted with ease. Therefore, the detection accuracy is raised as well.

Second Modified Embodiment

Figure 11A:
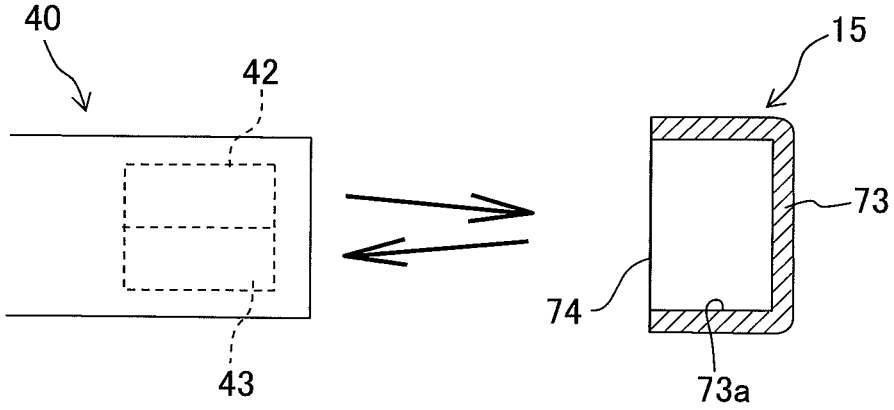
Figure 11B:
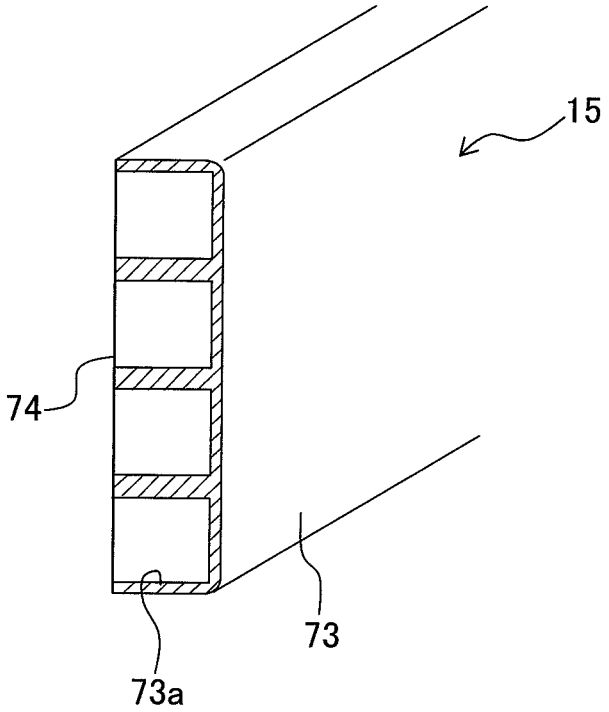

As shown in FIG. 11A, a tube 15 may have a tube body 73 which is made of a synthetic resin material or an elastomer and which is formed with a groove 73*a* extending in the longitudinal direction, and a thin film 74 which is composed of a synthetic resin or the like. As for the tube 15, the film 74 is stuck so that the groove 73*a* is covered therewith, and thus an ink channel is formed in the tube body 73. In this arrangement, the light, which is emitted from the light-emitting element 42, is radiated onto a flat outer surface of the thin film 74, and thus the light is easily transmitted between the inside and the outside of the tube 15. Alternatively, as shown in FIG. 11B, a tube 15 is also available, wherein four grooves 73*a*, which allow the four color inks to flow therethrough, are formed in a tube body 73, and a film 74 is stuck so that the four grooves 73*a* are commonly covered therewith. Accordingly, ink channels, through which the four color inks are allowed to flow respectively, are integrated into one unit.

Third Modified Embodiment

In the embodiment described above, the ink-state detection sensor 40 is provided with the four photosensors 41 for performing the detection for the four tubes 15 respectively (see FIG. 4). However, in the present teaching, it is not necessarily indispensable that the number of the tubes as the detection objectives should be coincident with the number of the ink-state detection sensors. A plurality of ink-state detection sensors may be provided for one tube. On the contrary, one ink-state detection sensor may be provided for a plurality of tubes. For example, one photosensor 41 may be constructed movably in the direction in which the plurality of tubes 15 are aligned (in the up-down direction in the example shown in FIG. 4). The ink states of the plurality of tubes 15 may be detected by means of one photosensor 41.

Fourth Modified Embodiment

When the carriage 2 is provided with a photosensor for detecting the end position in relation to the scanning direction of the recording paper P (recording medium), i.e., an end position detection sensor (end-position detecting mechanism) having a photosensor for detecting the recording paper width of the recording paper P, the end-position detection sensor can be also used as the ink-state detection sensor 40 for detecting the ink-state of the tube 15. When the end-position detection sensor, which is provided for the carriage 2, is used as the ink-state detection sensor as described above, it is unnecessary to provide any exclusive sensor for detecting the state of the ink contained in the tube 15.

Figure 12A:
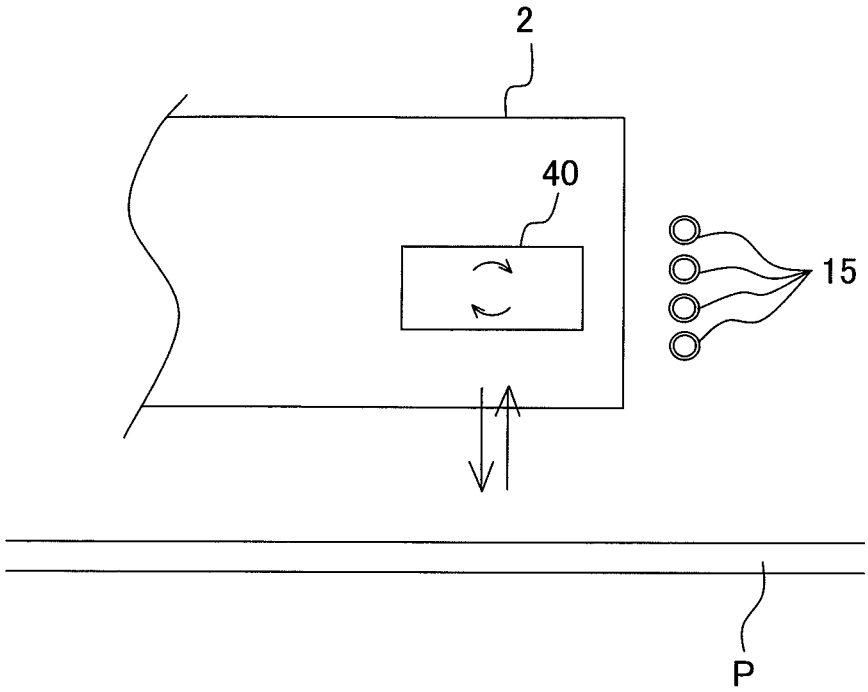
Figure 12B:
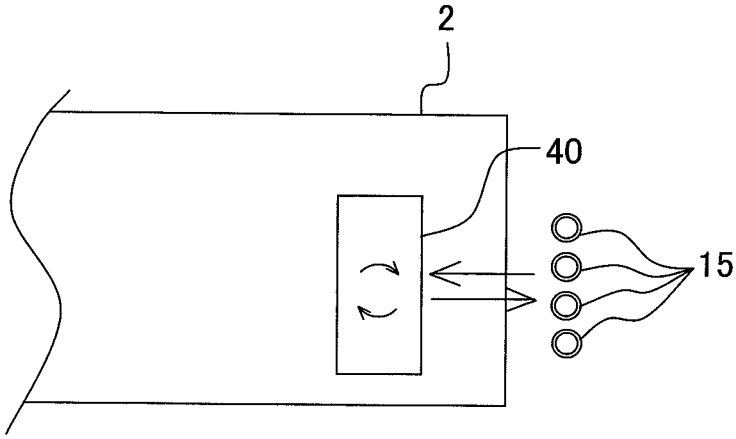

However, the end-position detection sensor emits the light toward the recording paper P when the end-position is detected. Therefore, in order to use the end-position detection sensor as the ink-state detection sensor when the tube 15 is positioned at the side position of the carriage 2 as shown in FIG. 4 of the embodiment described above, it is necessary that the end-position detection sensor should be constructed so that the light emitting direction of the sensor can be changed. For example, as shown in FIG. 12, an ink-state detection sensor 40 may be attached to the carriage 2 so that the ink-state detection sensor 40 can be rotated by 90 degrees. When the end position is detected in the scanning direction of the recording paper P (direction perpendicular to the plane of the paper in FIG. 12) as shown in FIG. 12A, the light emitting direction of the ink-state detection sensor 40 is directed downwardly. As shown in FIG. 12B, when the state of the ink contained in the tube 15 is detected, the light emitting direction of the ink-state detection sensor 40 is switched to the lateral direction.

Fifth Modified Embodiment

Figure 13:
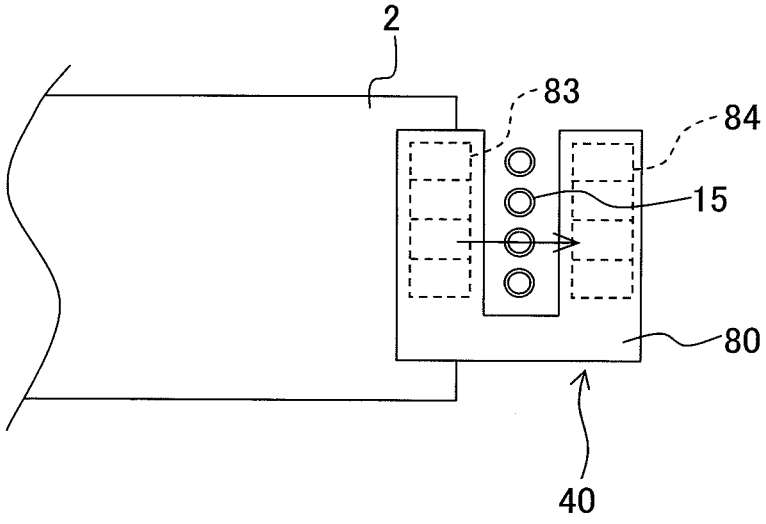
FIG. 13 shows an ink state detection sensor composed of a transmission type photosensor according to a fifth modified embodiment.

The ink-state detection sensor 40 may be composed of a transmission type photosensor. For example, as shown in FIG. 13, the following arrangement is also available. That is, the ink state detection sensor 40, which is provided on the carriage 2, includes a sensor body 80, and a light-emitting element 83 and a light-receiving element 84 which are provided on the sensor body 80 so that the tubes 15 are interposed therebetween. The light, which is emitted from the light-emitting element 83 toward the tube 15 and which is transmitted through the tube 15, is received by the light-receiving element 84 disposed on the opposite side.

Sixth Modified Embodiment

The ink-state detection sensor 40 is not limited to the photosensor described above. It is possible to use various sensors capable of detecting the liquid-state including, for example, the concentration of the ink contained in the tube, the viscosity, the presence or absence of the bubble, and the color. For example, it is also possible to use a sensor which utilizes the ultrasonic wave and a sensor which utilizes the difference in the capacitance or the electric conductivity depending on the presence or absence of the bubble contained in the tube 15. Further, it is also allowable to use an image sensor as those adopted in image scanners. In this case, the position and the size of the bubble and/or the viscosity-increased ink can be detected by photographing the interior of the transparent tube 15 by means of the image sensor and applying the known image recognition processing to the photographed or picked up image data.

Seventh Modified Embodiment

Figure 14A:
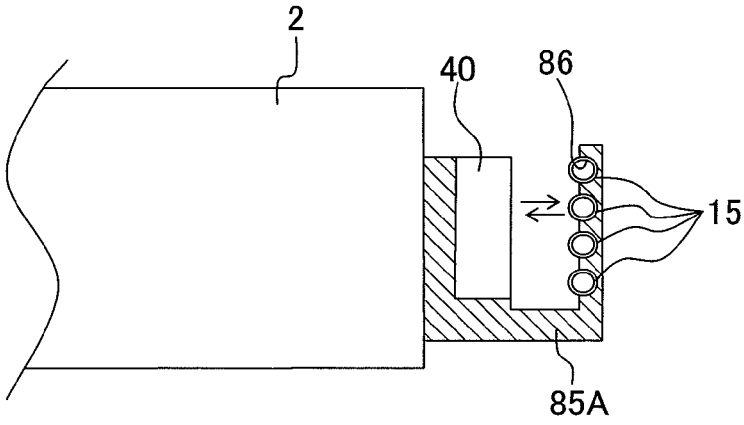
FIGS. 14A, 14B and 14C show tube holding members according to a seventh modified embodiment.

The flexible tube 15 is easily bent and deformed to change the position when any external force is allowed to act during the movement of the carriage 2. Therefore, in order to accurately detect the ink-state by means of the ink-state detection sensor 40, it is preferable that the displacement of the tube portion as the detection objective is regulated to be small. Therefore, a member, which regulates the displacement of the tube, may be provided on a part or all of the flexible tube. For example, as shown in FIG. 14A, the carriage 2 may be provided with a tube holding member 85A, and the displacement of the tube 15 may be regulated thereby. The tube holding member 85A is provided with an ink-state detection sensor 40 having a reflection type photosensor, and the tube holding member 85A is formed with four grooves 86 which are opposed to the ink-state detection sensor 40. The four tubes 15 are retained in the four grooves 86 respectively so that the four tubes 15 are slidable in the longitudinal direction. Further, the displacement of a portion of the tube, which is provided especially in the up-down direction and which is detected by the ink-state detection sensor 40, is regulated when the carriage 2 is moved. It is not necessarily indispensable that the ink-state detection sensor 40 should be provided on the tube holding member 85A as shown in FIG. 14A. The ink-state detection sensor 40 may be provided on the carriage 2 as shown in FIG. 4 of the embodiment described above.

Figure 14B:
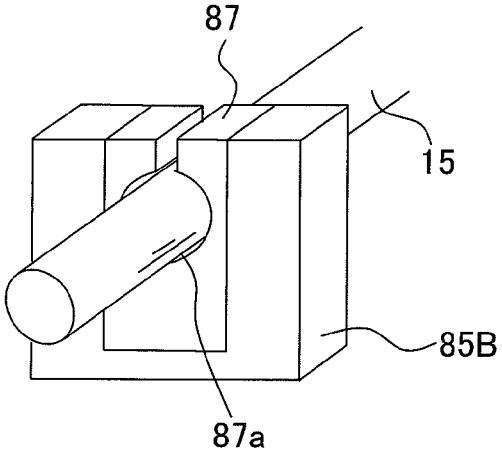
Figure 14C:
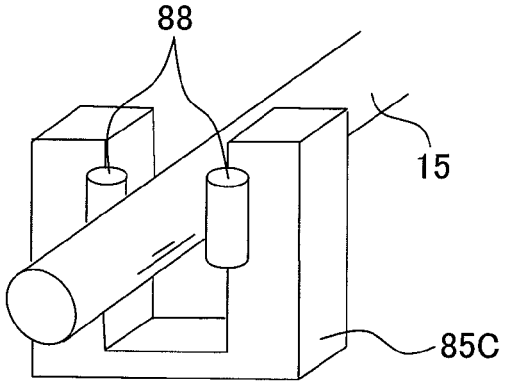

Alternatively, as shown in FIG. 14B, a tube holding member 85B may have an elastic member 87 which is formed with an insertion hole 87*a* and which is divided into two at an upper portion of the insertion hole 87*a*. Further, the tube 15 may be inserted into the insertion hole 87*a* of the elastic member 87, the tube 15 may be tightened by the elastic member 87, and thus the tube 15 may be retained by the tube holding member 85B. In this arrangement, both of the displacements of the tube 15 in the two directions perpendicular to the longitudinal direction respectively (up-down direction and left-right direction in the drawing) are regulated. Further alternatively, as shown in FIG. 14C, a tube holding member 85C may have a pair of rollers 88 for interposing the tube 15. In this arrangement, the tube holding member 85*c* can be smoothly moved in the longitudinal direction with respect to the tube 15 while regulating the displacement of the tube 15 in the left-right direction in the drawing by means of the pair of rollers 88. In FIGS. 14B and 14C, the ink-state detection sensor 40 is omitted from the illustrations. However, the ink-state detection sensor 40 is provided at any appropriate position of the carriage 2 or the tube holding members 85B, 85C opposed to the tube 15.

As described above, when the part of the tube 15 to be detected by the ink-state detection sensor 40 is retained or held by the tube holding member 85 (85A to 85C) which is movable integrally with the ink-state detection sensor 40, the displacement of the tube 15 is regulated in the direction perpendicular to the longitudinal direction. In this case, the position of the part of the tube 15 as the detection objective of the ink-state detection sensor 40 is hardly deviated with respect to the ink-state detection sensor 40. Therefore, the detection accuracy of the ink-state detection sensor is improved.

Eighth Modified Embodiment

In the embodiment described above, the ink-state detection sensor 40 is constructed such that the ink-state detection sensor 40 is provided on the carriage 2 and the ink-state detection sensor 40 is movable in the longitudinal direction of the tube 15 integrally with the carriage 2. Therefore, when the detection is performed by means of the ink-state detection sensor 40, the ink jet head 3 is also moved together with the carriage 2. During this process, the tube 15, which is connected to the head 3, is deformed or displaced by the external force allowed to act thereon in some cases. In such a situation, the detection accuracy of the sensor 40 is lowered. In this viewpoint, it is preferable that the ink-state detection sensor 40 is constructed to be relatively movable with respect to the ink-jet head 3 so that the ink-state detection sensor 40 is moved independently in the longitudinal direction with respect to the tube 15 in the stationary state to perform the detection, without allowing the ink-state detection sensor 40 to move integrally with the ink-jet head 3 (carriage 2) to perform the detection.

Figure 15:
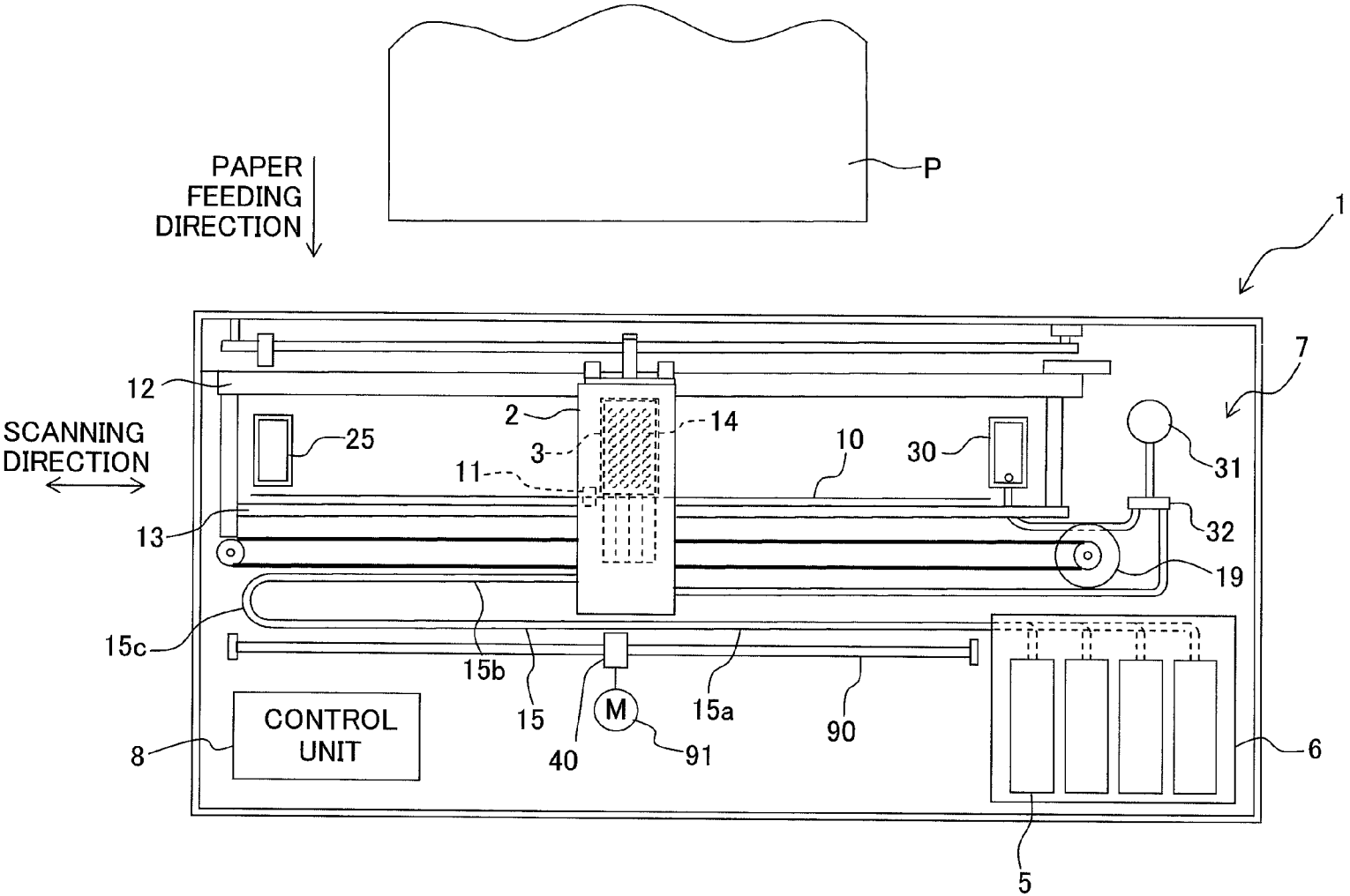
FIG. 15 shows a plan view illustrating a schematic arrangement of a printer according to an eighth modified embodiment.

For example, as shown in FIG. 15, an ink-state detection sensor 40 may be provided distinctly from the carriage 2. The ink-state detection sensor 40 may be movable in the longitudinal direction of the tube 15 in a state of being guided by a guide shaft 90 extending in the scanning direction (longitudinal direction of the tube 15). In this arrangement, the ink-state detection sensor 40 can be driven by a sensor driving motor 91 (movement-driving mechanism) even in a state in which the carriage 2 stops and the tube 15 stands still. Therefore, the ink state of the tube 15 can be detected while moving the ink-state detection sensor 40 in the longitudinal direction of the tube 15.

Ninth Modified Embodiment

In the embodiment described above, as also appreciated from FIG. 1, it is difficult that the entire length of the tube 15 connected to the ink jet head 3 carried on the carriage 2 as well is designated as the detection objective by using the ink-state detection sensor 40 carried on the carriage 2. In the embodiment described above, only the tube portion 15*a*, which ranges from the bent and inverted portion 15*c* to the holder 6, is designated as the detection objective. However, in this arrangement, it is impossible to detect the bubble and the viscosity-increased ink existing at the bent and inverted portion 15*c* and the tube portion 15*b* ranging from the bent and inverted portion 15*c* to the ink-jet head 3. Accordingly, in view of the fact that the detection is performed over the entire length in the longitudinal direction of the tube 15, it is preferable that the ink-state detection sensor 40 can be moved along the tube 15 while following the bending thereof as well.

Figure 16A:
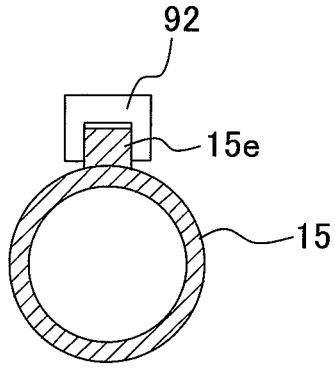
Figure 16B:
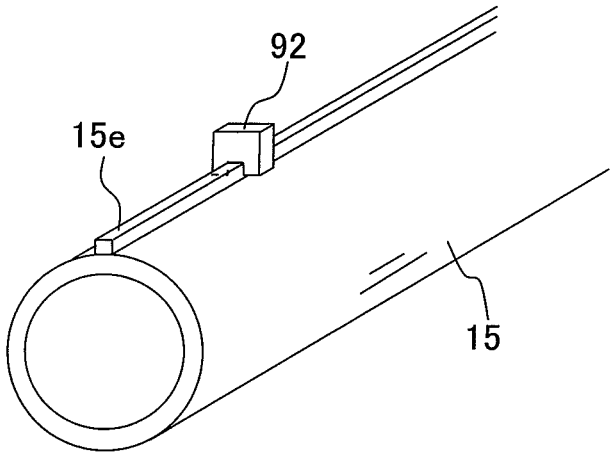

A specified example is shown below. As shown in FIG. 16, a guide section 15*e*, which extends in the longitudinal direction of the tube 15, is integrally formed on the outer surface of the tube 15, and a sensor holding member 92, which is engageable with the guide section 15*e* of the tube 15, is constructed movably along the guide section 15*e*. Although not shown, the sensor holding member 92 is provided with an ink-state detection sensor and a driving mechanism which allows the sensor holding member 92 to travel by itself. The sensor holding member 92 is allowed to travel by itself along the tube 15 while following the bent portion thereof as well, and thus the ink-state can be detected over the entire length of the tube 15.

Tenth Modified Embodiment

The ink-jet printer concerning the embodiment described above is the so-called serial type ink-jet printer in which the ink-jet head 3 is carried on the carriage 2 and the ink-jet head 3 is reciprocatively moved in the scanning direction parallel to the widthwise direction of the recording paper P. However, the present teaching is not limited thereto. The present teaching is also applicable, for example, to a printer having a line type ink-jet head 3 which is lengthy or is elongated in the widthwise direction of the recording paper P (scanning direction of the carriage as shown in FIG. 1), wherein the liquid droplet jetting position is fixed. However, in this case, the carriage 2 for moving the ink-jet head 3 is absent. Therefore, in order to move the ink state detection sensor 40, it is necessary to provide an arrangement for moving the ink-state detection sensor 40 singly with respect to the tube 15, for example, as in the eighth modified embodiment (FIG. 15) and the ninth modified embodiment (FIG. 16).

Eleventh Modified Embodiment

It is not necessarily indispensable that one ink-state detection sensor 40 should be moved in the longitudinal direction of the tube 15. The ink state can be also detected at a plurality of portions of the tube 15 by arranging a plurality of ink-state detection sensors 40 in the longitudinal direction of the tube 15.

Twelfth Modified Embodiment

It is also allowable that the ink-state detection sensor 40 detects whether or not any ink of another color is mixed in the ink, without being limited to the detection to detect whether or not the viscosity-increased portion is present in the ink in the tube 15 or whether or not the bubble is mixed. It is considered that the ink of any different color is mixed into the tube, for example, if a user erroneously inserts an ink cartridge of any different color into the cartridge installing section when the ink cartridge is exchanged, or if any color mixture ink causes the counterflow from the nozzles on account of any reason. In particular, if the dark color ink such as the black ink or the like is mixed into the pale color ink such as the yellow ink or the like, then the printing quality is extremely deteriorated, if such an ink is used as it is for the printing and any color mixture ink is discharged, because the difference in the color between the color mixture ink and the original ink is extremely large. In such a situation, the ink-state detection sensor 40 may have a color mixture ink sensor 40 (color mixture liquid sensor, see FIG. 7) for detecting the color mixture ink. In this case, the color mixture ink sensor 40*a* may be a color sensor for detecting the color of the ink. The color mixture ink has a concentration different from those of the other inks. Therefore, the color mixture ink sensor 40*a* may be a concentration sensor for detecting the concentration of the ink. As described above, for example, if the dark color ink such as the black ink or the like is mixed into the pale color ink such as the yellow ink or the like, the light transmittance and the light reflectance of the portion of the color mixture ink are greatly different from those of the portion of the pale color ink. Accordingly, the color mixture ink sensor 40*a* may be an optical sensor of the transmission type or the reflection type as described above. Alternatively, the color mixture sensor 40*a* may be a combination of the sensors as described above. In any case, the presence or absence of the color mixture ink, the position of the color mixture ink, and the size of the color mixture ink are detected for each of the four tubes 15 from the detection signal of the color mixture ink sensor 40*a* and the position information of the carriage 2 detected by the position detection sensor 11 by using a color mixture ink detecting section 68 (color mixture liquid-detecting mechanism, see FIG. 7) provided for the state detecting section 61. If the color mixture ink detecting section 68 detects that the color mixture ink is present in the tube 15, the color mixture ink can be removed from the tube 15 by using the purge mechanism 7 in the same manner as the case in which the bubble and/or the viscosity-increased ink is/are removed as described above.

It is possible to perform the control and the detection in various forms other than those of the control and the detection referred to in the embodiment described above by using the information (position and size) in relation to the bubble contained in the tube 15 detected by the bubble detecting section 66 on the basis of the detection signal of the ink-state detection sensor 40. An explanation will be made below about a modified embodiment in relation to the use of the detection signal of the ink-state detection sensor 40.

Thirteenth Modified Embodiment

A certain amount of the bubble can be stored in the subtank 4. Therefore, even when the bubble contained in the tube 15 is detected, it is unnecessary to perform the gas discharge purge every time when the bubble is detected. In other words, the following procedure is also available. That is, it is judged whether or not the total bubble amount in the subtank 4 exceeds the maximum storage amount assuming that the bubble, which is detected at the present point in time, is fed to the subtank 4. The gas discharge purge is performed only when it is predicted that the total bubble amount in the subtank 4 exceeds the maximum storage amount.

Figure 17:
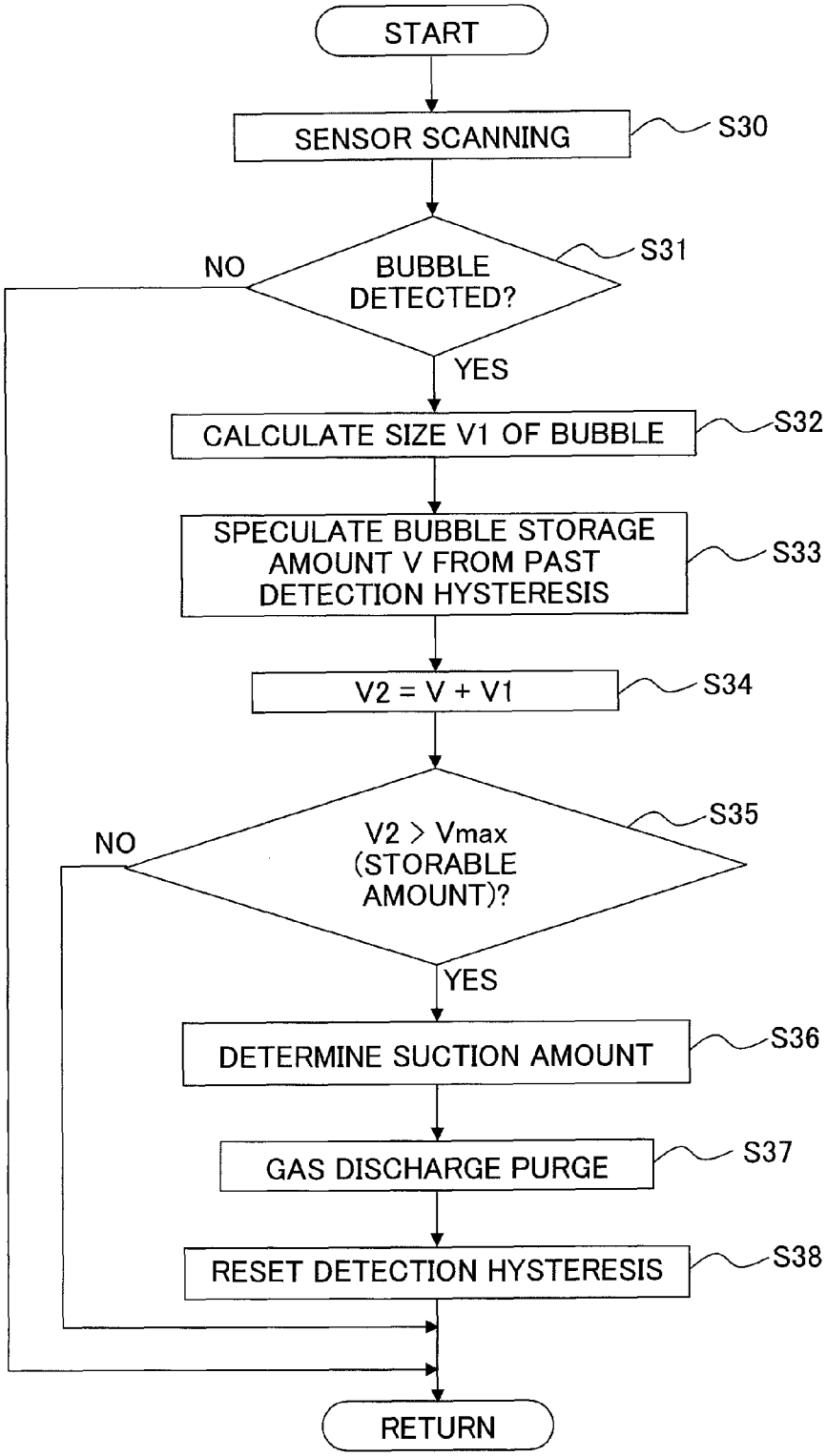
FIG. 17 shows a flow chart illustrating the bubble discharge control according to a thirteenth modified embodiment.

FIG. 17 shows a flow chart illustrating the bubble discharge control according to a thirteenth modified embodiment. At first, in the thirteenth modified embodiment, the control unit 8 of the printer 1 retains or stores the information (detection hysteresis) about the size of the bubble contained in the tube 15 detected by the bubble detecting section 66 during a period until arrival at the present point in time after the completion of the previous gas discharge purge.

When the bubble discharge control is started, the scanning is performed with the ink state detection sensor 40 (S30). When any bubble is detected (S31: Yes), the size V1 of the bubble is calculated by the bubble detecting section 66 (S32). Subsequently, the bubble detecting section 66 refers to the detection hysteresis described above, and the sizes (amounts) of bubbles detected in the past are added up to thereby estimate the bubble amount V stored in the subtank 4 at the present point in time (S33). That is, the bubble detecting section 66 corresponds to the bubble storage amount-estimating mechanism according to the present teaching.

Subsequently, the purge control section 62 calculates the bubble amount in the subtank V2 (=V+V1) on the assumption that the bubble contained in the tube 15 is fed to the subtank 4 (S34). It is judged whether or not the bubble amount in the subtank V2 exceeds the predetermined maximum bubble storage amount Vmax capable of being stored in the subtank 4 (S35). It is noted that the maximum bubble storage amount Vmax is the storage limit bubble amount which is determined in view of the design, for example, from the volume and the internal channel structure of the subtank 4, at which it is judged that the bubble flows to the ink-jet head 3 when the suction purge or the printing operation of the ink-jet head 3 is performed, if any additional amount of the bubble flows into the subtank 4.

If V2 is not more than Vmax (S35: No), then it is judged that it is unnecessary to discharge the bubble at the present point in time, and the routine returns. On the other hand, if V2 exceeds Vmax (S35: Yes), the purge control section 62 judges that it is necessary to discharge the bubble so that the bubble does not flow into the ink-jet head 3. The suction amount of the suction pump 31 is determined (S36) so that both of the bubble amount V contained in the subtank 4 and the bubble V1 contained in the tube 15 can be discharged. The suction pump 31 is controlled to perform the gas discharge purge (S37). All of the bubbles contained in the subtanks 4 are discharged by the gas discharge purge. Therefore, the past bubble detection hysteresis is reset or erased (S38), and the routine returns from the sequence shown in FIG. 17.

In this way, the gas discharge purge is performed only when it is predicted that the bubble storage amount in the subtank 4 exceeds the maximum bubble storage amount. Accordingly, it is possible to maximally avoid any unnecessary execution of the gas discharge purge. If the suction pump 31 is driven while exceeding the bubble amount stored in the subtank 4, then not only the bubble contained in the subtank 4 is discharged, but the ink is also discharged simultaneously. However, when the suction amount of the suction pump 31 is controlled, it is possible to decrease the ink to be discharged (wasted or discarded) during the discharge of the bubble.

Fourteenth Modified Embodiment

When the bubble contained in the tube 15 is disposed at a position separated far from the ink jet head 3, a certain period of time is required until the bubble arrives at the ink-jet head 3. Therefore, it is unnecessary to immediately discharge the bubble. In the case of the gas discharge purge, the bubble is discharged from the subtank 4 connected directly to the ink jet head 3. Therefore, it is necessary that a large amount of the ink, which exists between the subtank 4 and the bubble, should be discharged previously before the bubble contained in the tube 15 is discharged. Therefore, it is preferable that the bubble is discharged when the bubble exists at a position disposed near to the ink-jet head 3 (subtank 4). However, it is necessary to avoid such a situation that the bubble arrives at the ink-jet head 3 when the ink contained in the tube 15 is moved toward the ink-jet head 3 in accordance with the printing operation (liquid droplet jetting operation) of the ink-jet head 3. In view of the above, it is also allowable to determine whether the bubble is discharged immediately or the bubble is discharged after performing the printing operation by the ink-jet head 3 to some extent depending on the position of the bubble when the bubble is detected by the bubble detecting section 66.

Figure 18:
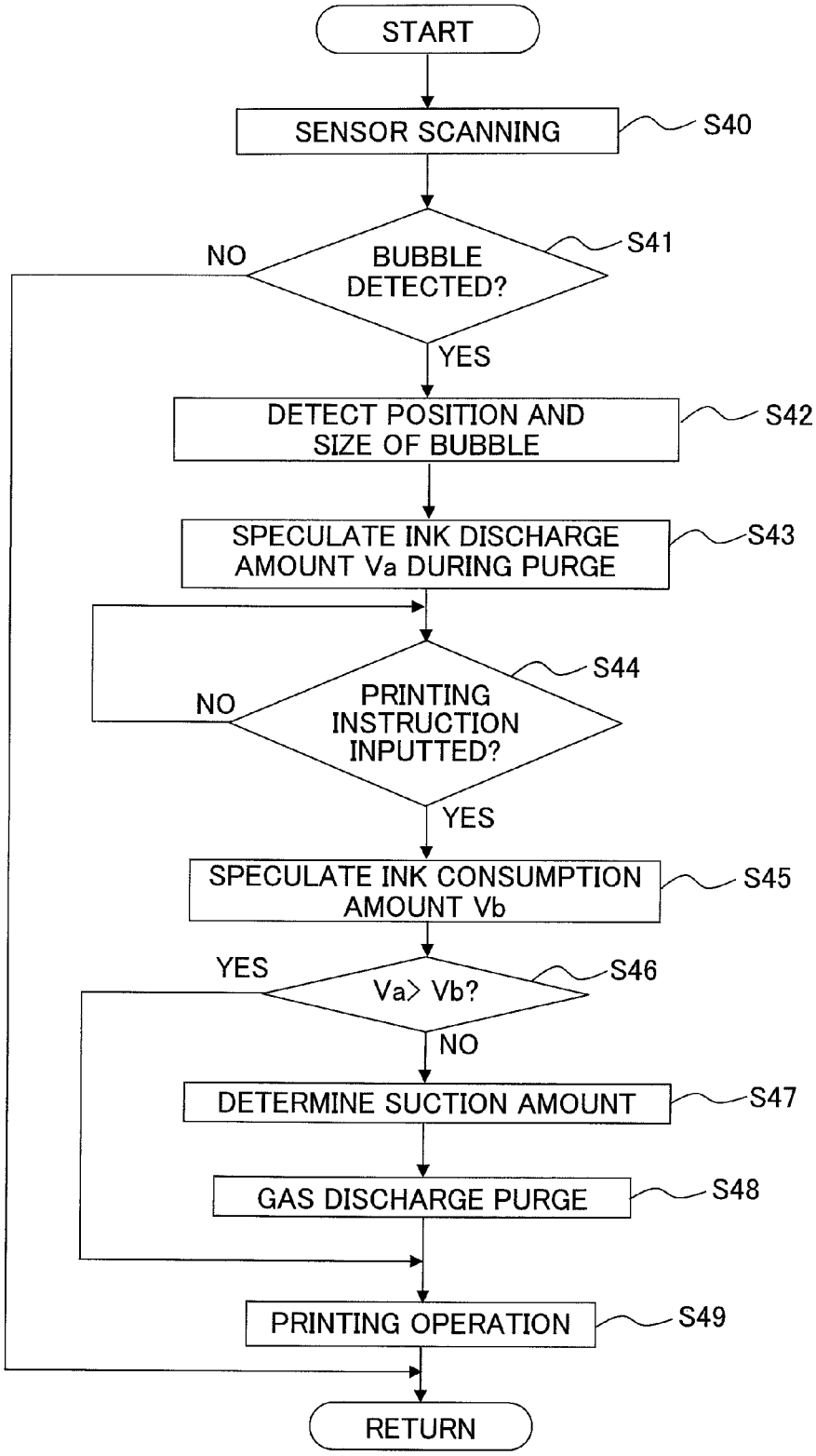
FIG. 18 shows a flow chart illustrating the bubble discharge control according to a fourteenth modified embodiment.

FIG. 18 shows a flow chart illustrating the bubble discharge control according to a fourteenth modified embodiment. When the bubble discharge control is started, the scanning is performed with the ink state detection sensor 40 (S40). If any bubble is detected (S41: Yes), the position and the size of the bubble are detected by the bubble detecting section 66 (S42). Further, the purge control section 62 estimates the ink amount existing in the region ranging from the position of the bubble detected by the bubble detecting section 66 to the subtank 4, i.e., the ink amount Va to be discharged together with the bubble when the bubble is discharged from the subtank 4 by performing the gas discharge purge (S43). The routine waits in this state until the printing instruction is inputted. When the printing instruction is inputted from PC 70 (S44: Yes), the head control section 63 estimates the ink amount to be consumed by the ink jet head 3 when the printing is performed on the basis of the inputted printing data (S45).

Subsequently, the purge control section 62 compares the ink amount Va estimated in S43 with the ink consumption amount Vb to be consumed by the ink-jet head 3 as estimated in S45 (S46). When Va is larger than Vb (S46: Yes), it is judged that the bubble contained in the tube 15 does not arrive at the subtank 4 even if the printing is performed with the ink-jet head 3. The head control section 63 allows the ink jet head 3 to perform the printing operation.

On the other hand, when Va is not more than Vb (S46: No), it is judged that the bubble contained in the tube 15 arrives at the subtank 4 even if the printing is performed with the ink jet head 3. The purge control section 62 determines the suction amount of the suction pump 31 (S47) to perform the gas discharge purge (S48). After that, the head control section 63 allows the ink jet head 3 to perform the printing operation (S49).

When the printing operation is performed without performing the gas discharge purge (S46 Yes→S49), the bubble still remains in the tube 15. Therefore, it is preferable to execute the series of steps from S40 thereafter every time when the printing instruction is supplied from PC 70.

In the fourteenth modified embodiment, it is possible to estimate whether or not the bubble contained in the tube 15 arrives at the ink jet head 3 (subtank 4) when the ink is consumed by the printing operation performed by the ink-jet head 3. Therefore, it is possible to perform the gas discharge purge only when the gas discharge purge is really required by determining whether or not the gas discharge purge is to be performed prior to the printing operation.

Fifteenth Modified Embodiment

A fifteenth modified embodiment is an embodiment obtained by combining the thirteenth modified embodiment and the fourteenth modified embodiment described above. That is, when the bubble contained in the tube 15 is disposed at a position separated far from the ink-jet head 3, a certain period of time is required until the bubble arrives at the ink-jet head 3. Therefore, it is unnecessary to immediately discharge the bubble (fourteenth modified embodiment). Further, if a certain amount of the bubble can be stored in the subtank 4, even when the bubble contained in the tube 15 is detected, then it is unnecessary to perform the gas discharge purge every time when the bubble is detected (thirteenth modified embodiment).

Figure 19A:
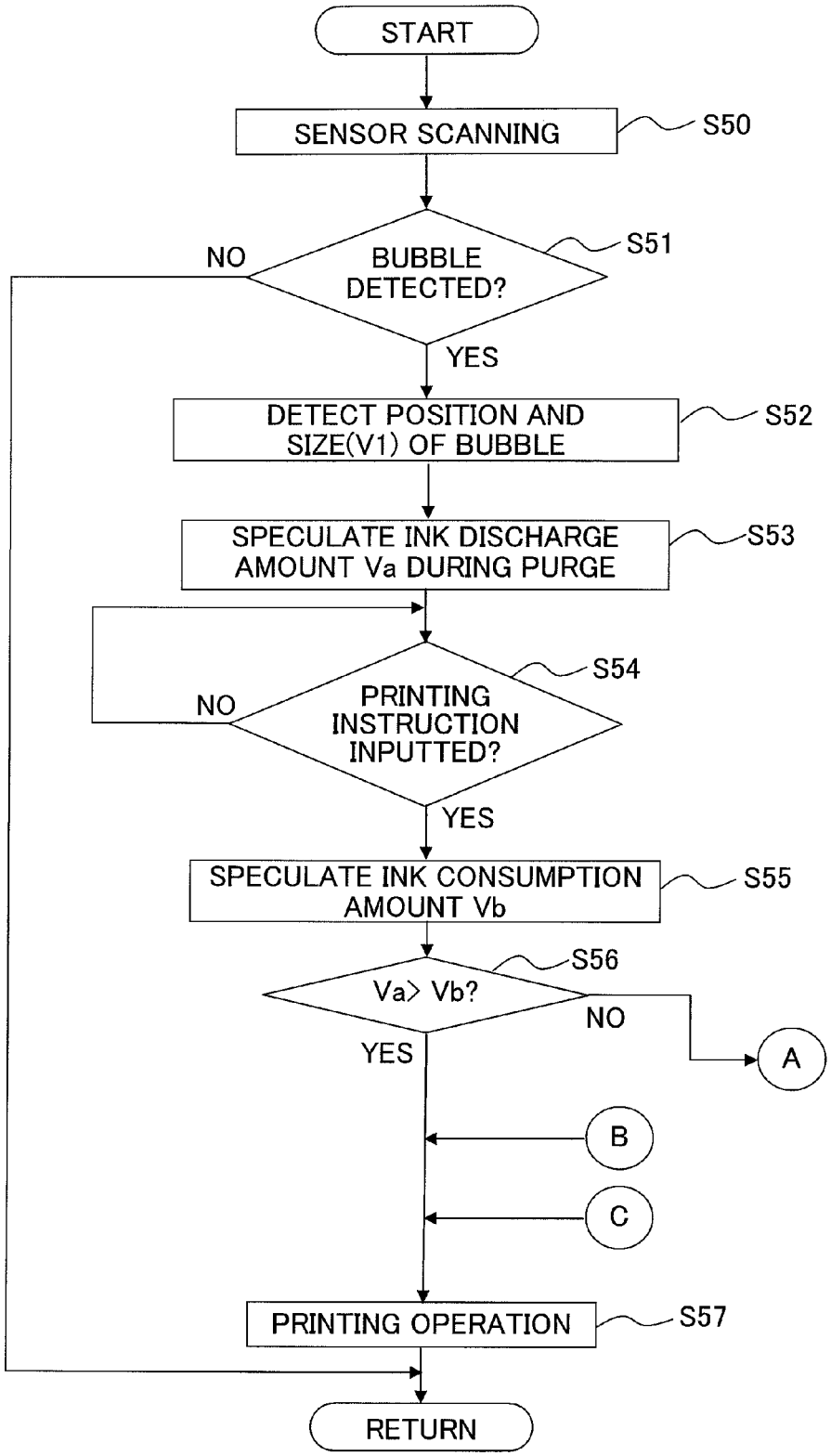
FIGS. 19A and 19B show flow charts illustrating the bubble discharge control according to a fifteenth modified embodiment.
Figure 19B:
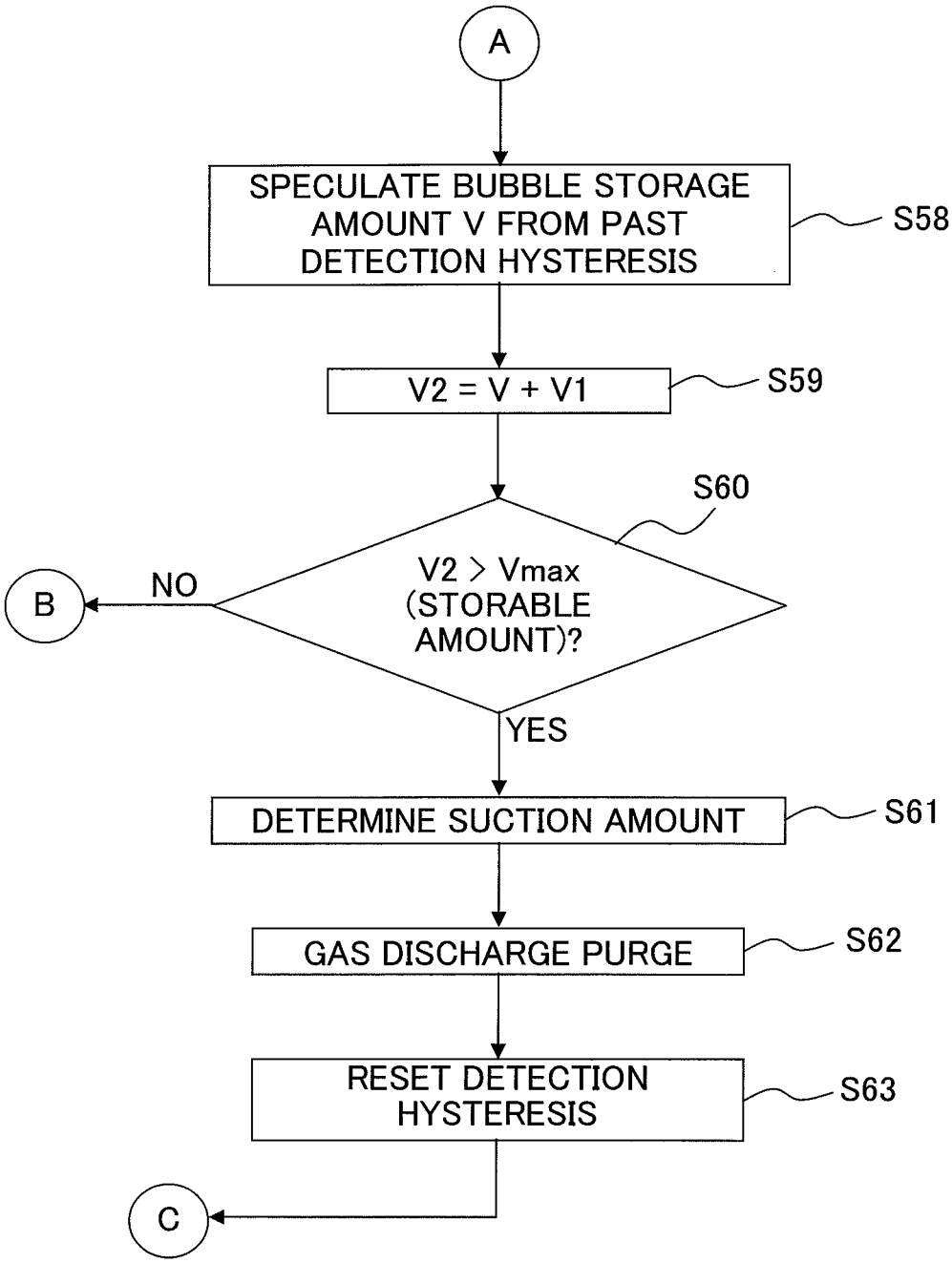

FIG. 19 shows a flow chart illustrating the bubble discharge control according to the fifteenth modified embodiment. In the fifteenth modified embodiment, the control unit 8 of the printer 1 retains the information (detection hysteresis) about the size of the bubble contained in the tube 15 detected by the bubble detecting section 66 during a period until arrival at the present point in time after the completion of the previous gas discharge purge.

When the bubble discharge control is started, the scanning is performed with the ink-state detection sensor 40 (S50). When any bubble is detected (S51: Yes), the position and the size (V1) of the bubble are detected by the bubble detecting section 66 (S52). The purge control section 62 estimates the ink amount Va existing in the region ranging from the position of the bubble detected by the bubble detecting section 66 to the subtank 4 (S53). After that, if the printing instruction is inputted from PC 70 (S54: Yes), the head control section 63 estimates the ink amount Vb to be consumed by the ink jet head 3 if the printing is performed based on the inputted printing data (S55).

Subsequently, the purge control section 62 compares the estimated ink amount Va with Vb. When Va is larger than Vb (S56: Yes), it is judged that the bubble contained in the tube 15 does not arrive at the subtank 4 even if the printing is performed with the ink-jet head 3. The head control section 63 allows the ink-jet head 3 to perform the printing operation (S57).

On the other hand, when Va is not more than Vb (S56: No), the bubble contained in the tube 15 arrives at the subtank 4 if the printing is performed with the ink-jet head 3.

At this stage, the bubble detecting section 66 refers to the detection hysteresis described above, and the sizes (amounts) of bubbles detected in the past are added up to thereby estimate the bubble amount V stored in the subtank 4 at the present point in time (S58).

Subsequently, the purge control section 62 calculates the bubble amount in the subtank V2 (=V+V1) on the assumption that the bubble contained in the tube 15 is fed to the subtank 4 when the printing is performed with the ink-jet head 3 (S59). It is judged whether or not the bubble amount in the subtank V2 exceeds the predetermined maximum bubble storage amount Vmax capable of being stored in the subtank 4 (S60).

When V2 is not more than Vmax (S60: No), then it is judged that it is unnecessary to discharge the bubble at the present point in time, and the head control section 63 allows the ink-jet head 3 to perform the printing operation (S57). On the other hand, when V2 exceeds Vmax (S60: Yes), the purge control section 62 judges that it is necessary to discharge the bubble so that the bubble does not flow into the ink jet head 3. The suction amount of the suction pump 31 is determined (S61) so that both of the bubble amount V contained in the subtank 4 and the bubble V1 contained in the tube 15 can be discharged. The suction pump 31 is controlled to perform the gas discharge purge (S62). It is noted that all of the bubbles contained in the subtanks 4 are discharged by the gas discharge purge. Therefore, the past bubble detection hysteresis is reset or erased (S63). After that, the ink jet head 3 is allowed to perform the printing operation (S57).

Sixteenth Modified Embodiment

When the time elapses while allowing the ink jet head 3 to stop in a state in which the bubble exists in the tube 15, the bubble grows on account of the invasion of the external air and the continuous evaporation of the ink. The growth of the bubble can be grasped from the position of the bubble detected at the present point in time by the bubble detecting section 66 and the position of the bubble detected therebefore. The growth of the bubble equals to the decrease in the volume of the ink and the progress of the viscosity increase corresponding to the amount of the growth. Therefore, it is possible to estimate the viscosity of the ink from the growth of the bubble (change of the bubble amount).

Figure 20:
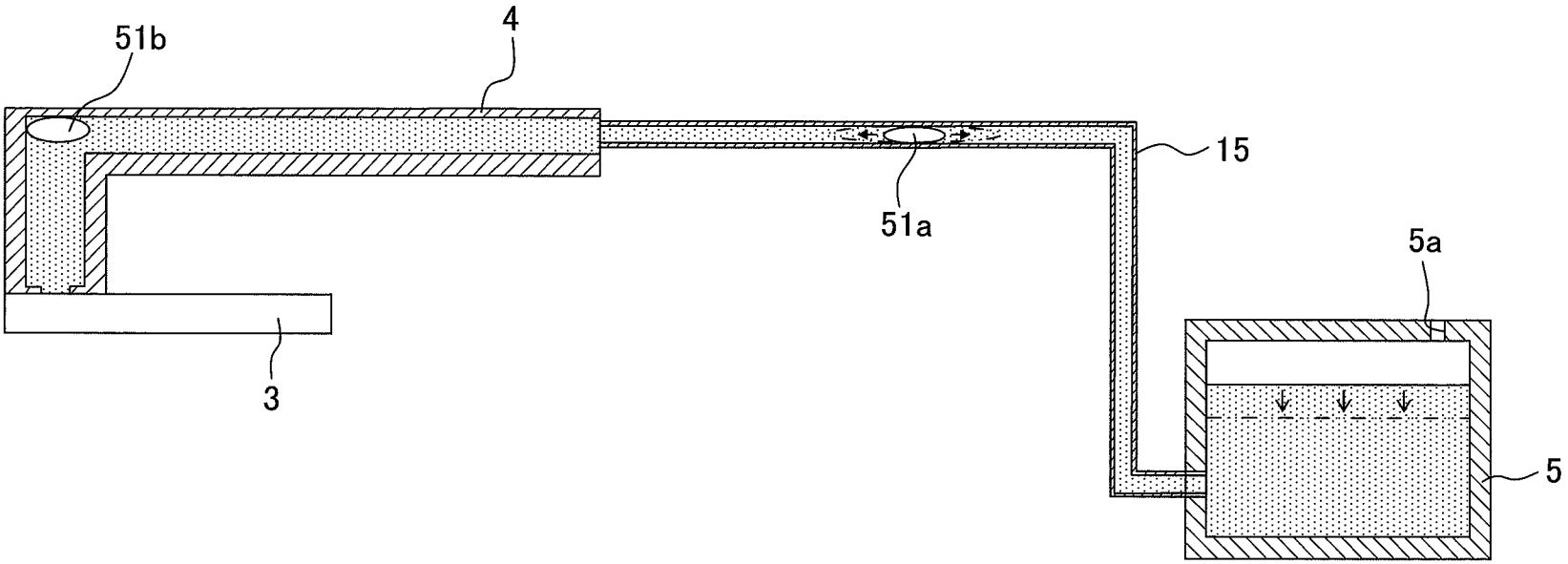
FIG. 20 shows a schematic arrangement of a printer to illustrate a sixteenth modified embodiment.
Figure 21:
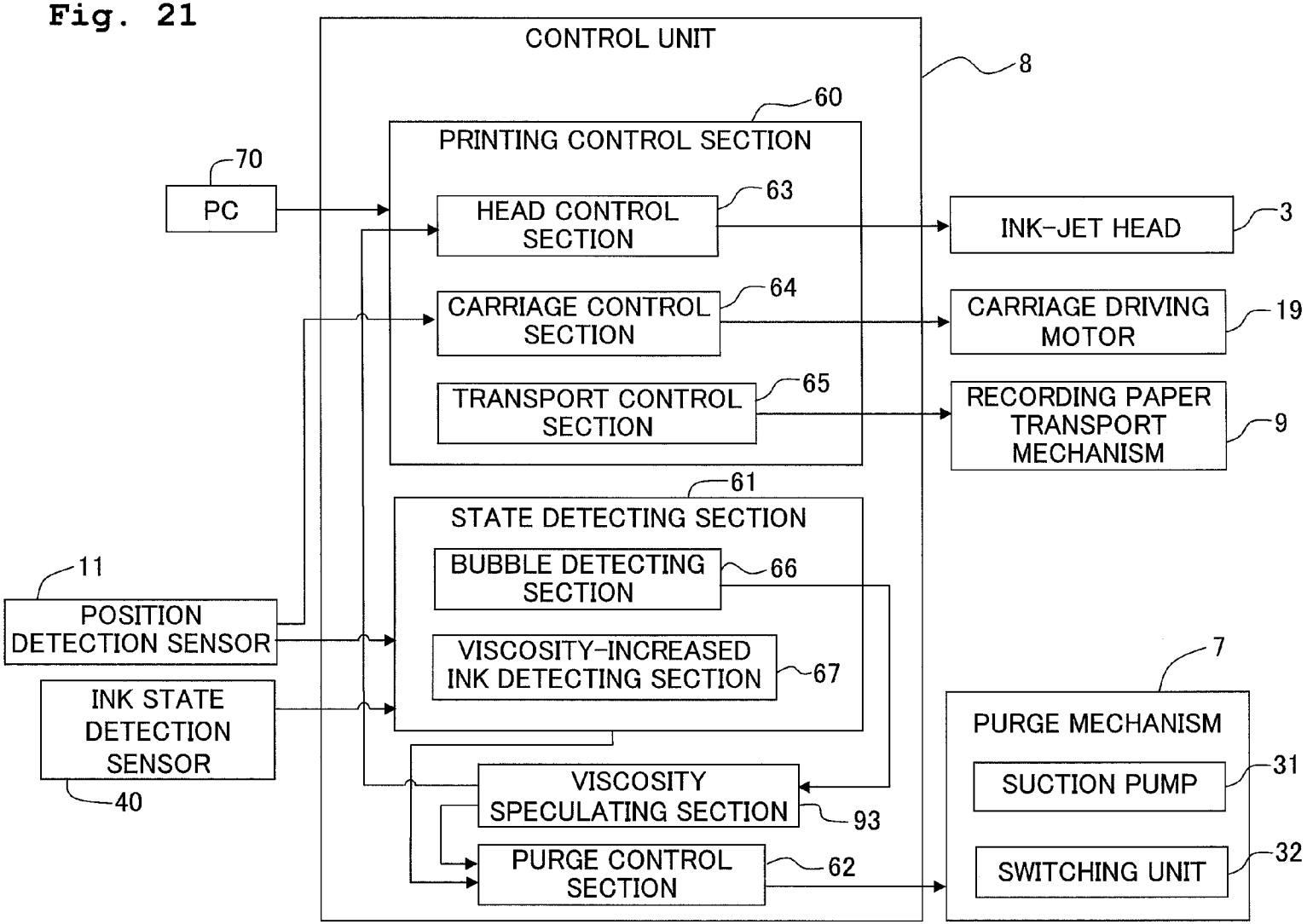
FIG. 21 shows a block diagram illustrating an electrical arrangement of the printer according to the sixteenth modified embodiment.

An explanation will be made about a specified technique for estimating the viscosity. As shown in FIG. 20, the subtank 4, which is positioned above the ink-jet head 3, is connected via the tube 15 to the ink cartridge 5 which is open to the atmospheric air by the atmospheric air communication hole 5*a*. On the other hand, as shown in FIG. 21, a control unit 8 of the printer of a sixteenth modified embodiment has a viscosity estimating section 93 (viscosity-estimating mechanism) which estimates the viscosity based on the position of the bubble detected by the bubble detecting section 66.

When the evaporation (viscosity increase) of the ink and the growth of the bubble 51*a* are caused in the tube 15, then the income and the outgo of the ink are caused between the tube 15 and the ink cartridge 5, and the liquid surface of the ink cartridge 5 is varied or fluctuated. However, the meniscus retaining force, which is provided on the side of the ink-jet head 3 (nozzles), is sufficiently higher than that provided on the side of the ink cartridge 5. Therefore, the meniscus position is not varied or fluctuated, and the income and the outgo of the ink are not caused on the nozzle side. Accordingly, in this procedure, the evaporation rate of the ink is estimated by detecting the volume change of the ink on the downstream side (nozzle side) of the bubble 51*a*.

The evaporation rate "r" of the ink is determined from the volume change of the ink on the downstream side from the bubble 51*a* during the period ranging from the last estimation to the present estimation. That is, the evaporation rate "r" of the ink can be expressed as eq. 1 by using the volume V0 of the ink on the downstream side at the last estimation (in the last time) and the volume V of the ink on the downstream side at the present estimation (in the present time).

$$r=V0-V/V0 \quad \text{(eq. 1)}$$

The volume V of the ink on the downstream side in the present time can be calculated from eq. 2 by using the volume V0 of the ink on the downstream side in the last time and the frontward movement volume ΔVt1 of the bubble in the tube.

$$V=V0-\Delta Vt1 \quad \text{(eq. 2)}$$

In this procedure, the ink volume V0 in the last time is the value which has been determined during the viscosity estimation in the last time and which is stored. The ink volume V0 in the last time is updated every time when the viscosity estimation is performed. The frontward movement volume ΔVt1 of the bubble in the tube indicates the frontward movement amount of the bubble 51*a* toward the downstream side, which is determined from the change of the position of the downstream end of the bubble 51*a* detected by the bubble detecting section 66.

However, in the above described equation (eq. 2), the growth of the bubble 51*b* existing in the subtank 4 is not taken into consideration. In order to take the bubble 51*b* in the subtank 4 into consideration as well, the growth volume ΔVs of the bubble in the subtank is further determined, and the following equation (eq. 3) is used in place of the equation (eq. 2) to determine the ink volume V on the downstream side in the present time.

$$V=V0-\Delta Vt1-\Delta Vs \quad \text{(eq. 3)}$$

In this procedure, the growth volume ΔVs of the bubble in the subtank can be calculated by multiplying the growth volume ΔVt2 of the bubble in the tube determined from the bubble position detected by the bubble detecting section 66 by a predetermined coefficient C. The coefficient C relates to the condition of the evaporation of the ink, such as the material, the structure, and the surface area, and reflects the difference in the bubble growth speed between the tube 15 and the subtank 4 having different conditions of the evaporation of the ink. The coefficient C is previously set at the designing stage, and it is stored in the control unit 8.

When the ink evaporation rate is determined from the equation (eq. 1), the viscosity estimating section 93 estimates the ink viscosity on the downstream side of the bubble from a previously stored correspondence table between the ink evaporation rate and the ink viscosity.

When the ink viscosity can be estimated as described above, it is possible to perform the following control. For example, when the head control section 63, which controls the ink-jet head 3, is allowed to give the high energy to the ink when the ink viscosity is high, it is possible to realize the same jetting characteristic as that obtained when the viscosity is low. When the purge control section 62, which controls the purge mechanism 7, raises the suction speed of the suction pump 31 when the ink viscosity is high, it is possible to reliably discharge the ink having the high viscosity by means of the suction purge. Further, it is also possible to estimate the viscosity of the ink in the ink-jet head 3 and/or the ink cartridge 5 by estimating the evaporation rate of the ink in the ink jet head 3 and/or the ink cartridge 5 from the evaporation rate "r" of the ink described above. In this procedure, if the viscosity of the ink is high, it is feared that the jetting failure may arise in the nozzle 14. Therefore, it is also effective to increase the amount and/or the number of times of the flashing to be performed before the printing or during the printing, and it is also effective to increase the frequency of the suction purge.

Seventeenth Modified Embodiment

The movement velocity of the ink in the tube 15 is determined from the change of the position of the bubble detected by the bubble detecting section. It is also possible to estimate the viscosity of the ink on the basis thereof.

For example, when the movement velocity of the ink, which is determined from the change of the position of the bubble detected by the bubble detecting section 66 when the ink is consumed by performing the liquid droplet jetting from the ink jet head 3 and/or performing the suction purge in a state in which the bubble exists in the tube 15, is smaller than the movement velocity of the ink which is assumed from the ink not subjected to the viscosity increase, the fluidization resistance is increased. Therefore, it can be judged that the viscosity of the ink is raised. The viscosity can be also estimated by detecting the movement velocity of the bubble when the suction purge is performed by the purge mechanism 7 to discharge a predetermined amount of the ink by means of the purge.

Alternatively, the flow (movement velocity) of the ink caused by the inertia, which is predicted from the scanning velocity of the carriage when the carriage 2 is moved in the scanning direction at a predetermined velocity, is compared with the movement velocity which is determined from the change of the position of the bubble detected by the bubble detecting section 66. The viscosity of the ink can be also estimated from the difference therebetween.

Eighteenth Modified Embodiment

If the leak arises at a part of the tube 15, when a predetermined amount of the ink is consumed by the ink-jet head 3 to generate the flow of the ink in the tube 15, then the actual movement velocity of the ink in the tube 15 is different from the movement velocity of the ink estimated from the ink amount to be consumed. Accordingly, when the movement velocity of the ink is determined from the position of the bubble brought about when the ink in the tube 15 flows, then it is also possible to detect the leak from the tube 15.

The embodiment and the modified embodiments thereof described above are described merely by way of example in every sense. The present invention is not limited to the embodiment and the modified embodiments. For example, a plurality of the modified embodiments may be carried out appropriately in combination.

The embodiment and the modified embodiments thereof described above are the examples in which the present teaching is applied to the ink jet printer which is one of liquid droplet jetting apparatuses. However, the application objective of the present teaching is not limited thereto. That is, the present teaching is applicable to any liquid droplet jetting apparatus provided with the structure for supplying various liquids to the head via the tube or tubes irrelevant to the type of the liquid to be jetted, the way of use, and the technical field in which the present teaching is used.

What is claimed is:

1. A liquid droplet jetting apparatus which jets liquid droplets of a liquid onto a medium, comprising:

a liquid droplet-jetting head which is configured to jet the liquid droplets;

a storage tank which is configured to store the liquid to be jetted by the liquid droplet-jetting head;

a tube which is configured to connect the liquid droplet jetting head and the storage tank;

a liquid-state detecting mechanism which is configured to be moveable along a longitudinal direction of the tube, and which is configured to output a detection signal regarding a state of the liquid contained in the tube at a plurality of positions in the longitudinal direction of the tube; and a controller which is configured to detect the state of the liquid based on a speed of a movement of the liquid-state detecting mechanism and a time period during which the detection signal, which is output by the liquid-state detecting mechanism while moving, varies across a threshold value.

2. The liquid droplet jetting apparatus according to claim 1, further comprising a movement-driving mechanism which is configured to move the liquid-state detecting mechanism in the longitudinal direction of the tube.

3. The liquid droplet jetting apparatus according to claim 2, further comprising:

a carriage which is configured to reciprocate in a scanning direction, which is configured to carry the liquid droplet jetting head thereon, and which comprises the liquid-state detecting mechanism thereon, wherein the tube is arranged to extend in the scanning direction from the liquid droplet-jetting head; and the carriage is configured to be driven by the movement-driving mechanism and the liquid-state detecting mechanism is configured to be movable in the longitudinal direction of the tube in accordance with movement of the carriage in the scanning direction.

4. The liquid droplet jetting apparatus according to claim 3, further comprising a transport mechanism which is configured to transport the medium in a transport direction perpendicular to the scanning direction, wherein the liquid-state detecting mechanism comprises a photosensor comprising a light-emitting element which is configured to emit light and a light-receiving element which is configured to receive the light; and the liquid-state detecting mechanism is configured to detect an end position in the scanning direction of the medium transported by the transport mechanism by emitting the light from the light-emitting element toward the medium and to detect the state of the liquid contained in the tube based on a light-receiving amount of the light-receiving element, by emitting the light from the light-emitting element toward the tube while moving in the longitudinal direction of the tube together with the carriage.

5. The liquid droplet jetting apparatus according to claim 3, further comprising a tube-holding member which is provided on the carriage, which is configured to move in the longitudinal direction of the tube integrally with the liquid-state detecting mechanism, and which is configured to regulate displacement of a part of the tube in a direction perpendicular to the longitudinal direction while holding the part of the tube for which the state of the liquid is detected by the liquid-state detecting mechanism.

6. The liquid droplet jetting apparatus according to claim 2, wherein the liquid-state detecting mechanism is configured to move relative to the liquid droplet-jetting head; and the moving driving mechanism is configured to move the liquid-state detecting mechanism in the longitudinal direction of the tube with respect to the tube which is in a stationary state.

7. The liquid droplet jetting apparatus according to claim 1, wherein the liquid-state detecting mechanism comprises a reflection type or transmission type photosensor which is provided with a light-emitting element which is configured to emit light toward the tube and a light-receiving element which is configured to receive the light.

8. The liquid droplet jetting apparatus according to claim 7, wherein an irradiation surface of the tube, which is irradiated with the light emitted by the light-emitting element, is formed as a flat surface.

9. The liquid droplet jetting apparatus according to claim 7, wherein a thickness of a portion of the tube irradiated with the light emitted by the light-emitting element is thinner than thicknesses of other portions of the tube different from the portion of the tube irradiated with the light emitted by the light-emitting element.

10. The liquid droplet jetting apparatus according to claim 1, wherein the storage tank includes a plurality of storage tanks which is configured to store a plurality of types of liquids respectively, the tube includes a plurality of tubes each of which is configured to connect one of the storage tanks and the liquid droplet-jetting head; and the liquid-state detecting mechanism is configured to detect respective states of the liquids contained in the tubes individually.

11. The liquid droplet jetting apparatus according to claim 1, further comprising a bubble-detecting mechanism which is configured to detect presence or absence of a bubble in the tube, a position of the bubble, and a size of the bubble based on a detection signal of the liquid-state detecting mechanism.

12. The liquid droplet jetting apparatus according to claim 11, further comprising:

a bubble discharge mechanism which is configured to discharge the bubble to be fed to the liquid jetting head from the tube, and a bubble discharge control mechanism which is configured to control a bubble discharge operation of the bubble discharge mechanism, wherein the bubble discharge control mechanism is configured to control the bubble discharge mechanism based on at least one of the size of the bubble and the position of the bubble detected by the bubble-detecting mechanism.

13. The liquid droplet jetting apparatus according to claim 12, further comprising a bubble storage member which intervenes between the liquid droplet jetting head and the tube and which is configured to store the bubble fed from the tube, wherein the controller is configured to estimate an amount of the bubble stored in the bubble storage member based on the size of the bubble detected by the bubble-detecting mechanism during a period ranging to a present point in time after completion of the bubble discharge operation of the bubble discharge mechanism performed immediately before, wherein the bubble discharge mechanism is configured so that the bubble stored in the bubble storage member is discharged; and the bubble discharge control mechanism is configured to control the bubble discharge mechanism based on the estimated bubble storage amount and the size of the bubble detected by the bubble detecting mechanism at the present point in time.

14. The liquid droplet jetting apparatus according to claim 12, wherein the bubble discharge control mechanism is configured to determine whether or not the bubble discharge operation is performed by the bubble discharge mechanism before the liquid droplet jetting head performs a liquid droplet jetting operation based on the position of the bubble detected by the bubble detecting mechanism.

15. The liquid droplet jetting apparatus according to claim 11, wherein the controller is configured to determine a speed of growth of the bubble in the tube based on the size of the bubble detected at a present point in time by the bubble detecting mechanism and the size of the bubble detected before the present point in time, and is configured to estimate a viscosity of the liquid in the tube based on the speed of growth of the bubble in the tube.

16. The liquid droplet jetting apparatus according to claim 11, wherein the controller is configured to determine a velocity of movement of the liquid based on a change of the position of the bubble detected by the bubble-detecting mechanism under a condition that a liquid droplet jetting operation of the liquid droplet jetting head is performed, and is configured to estimate a viscosity of the liquid in the tube based on the velocity of movement of the liquid.

17. The liquid droplet jetting apparatus according to claim 1, further comprising a viscosity-increased liquid-detecting mechanism which is configured to detect presence or absence of a viscosity-increased liquid in the tube, a position of the viscosity-increased liquid, and a size of the viscosity-increased liquid based on a detection signal of the liquid-state detecting mechanism.

18. The liquid droplet jetting apparatus according to claim 17, further comprising a viscosity-increased liquid discharge mechanism which is configured to discharge the viscosity-increased liquid contained in the tube, and a liquid discharge control mechanism which is configured to control a discharge operation of the viscosity-increased liquid discharge mechanism, wherein the liquid discharge control mechanism is configured to control the viscosity-increased liquid discharge mechanism based on at least one of the size of the viscosity-increased liquid and the position of the viscosity-increased liquid detected by the viscosity-increased liquid-detecting mechanism.

19. The liquid droplet jetting apparatus according to claim 1, wherein the liquid-state detecting mechanism has a color mixture liquid sensor which is configured to detect a color mixture liquid having a color that is different from a color of the liquid, the color mixture liquid being contained in the liquid in the tube; and the liquid droplet jetting apparatus further comprises a color mixture liquid-detecting mechanism which is configured to detect presence or absence of the color mixture liquid in the tube, a position of the color mixture liquid, and a size of the color mixture liquid based on a detection signal of the color mixture liquid sensor.

* * * * *